US010267075B2

(12) United States Patent
Kenyon et al.

(10) Patent No.: US 10,267,075 B2
(45) Date of Patent: Apr. 23, 2019

(54) SELF-CONTAINED DOOR HINGE MECHANISM

(71) Applicant: NIO USA, Inc., San Jose, CA (US)

(72) Inventors: Shane Louis Kenyon, Milpitas, CA (US); Nermin Mujcinovic, Fremont, CA (US)

(73) Assignee: NIO USA, Inc., San Jose, CA (US)

( * ) Notice: Subject to any disclaimer, the term of this patent is extended or adjusted under 35 U.S.C. 154(b) by 0 days.

(21) Appl. No.: 15/583,550

(22) Filed: May 1, 2017

(65) Prior Publication Data

US 2018/0313123 A1 Nov. 1, 2018

(51) Int. Cl.
*E05D 11/08* (2006.01)
*E05D 3/02* (2006.01)

(52) U.S. Cl.
CPC ..... *E05D 11/087* (2013.01); *E05D 3/02* (2013.01); *E05Y 2900/531* (2013.01); *E05Y 2900/536* (2013.01); *E05Y 2900/548* (2013.01)

(58) Field of Classification Search
CPC ..... Y10T 16/5403; Y10T 16/54033; Y10T 16/54034; Y10T 16/540345; Y10T 16/54028; Y10T 16/54029; E05D 11/1057; E05D 11/06; E05D 11/08; E05D 11/087; E05D 2011/1035; E05D 3/02; E05Y 2900/531; E05Y 2900/536; E05Y 5900/548
See application file for complete search history.

(56) References Cited

U.S. PATENT DOCUMENTS 1,742,698 A * 1/1930 Fellows ..... E05D 11/087 16/340
1,956,040 A * 4/1934 Meyer ..... E05D 11/081 16/340
2,376,965 A * 5/1945 Otto ..... E05D 11/087 16/339
5,146,808 A * 9/1992 Hoshino ..... F16M 13/027 16/235
6,029,314 A * 2/2000 Kluting ..... E05D 11/1085 16/322

(Continued)

FOREIGN PATENT DOCUMENTS

DE 4210438 A1 * 10/1993 ..... F16C 11/103
DE 4212181 A1 * 10/1993 ..... E05D 11/087

(Continued)

*Primary Examiner* — Chuck Y Mah
(74) *Attorney, Agent, or Firm* — Sheridan Ross P.C.

(57) ABSTRACT

A self-contained hinge mechanism is provided including a hinge movement control assembly. The hinge movement control assembly includes a number of stacked alternating friction rings and pressure disks providing a tunable pivoting resistance. As the hinge mechanism is actuated, an internal shaft and a set of friction rings rotationally-locked to the internal shaft and door moves relative to a set of pressure disks rotationally-locked to a fixed hinge mechanism housing and mount frame. A resistance to the pivoting of the hinge mechanism elements is provided by the clamping force of multiple force members moving the pressure disks along axial translation guides of the housing closer to one another and sandwiching the friction rings closer together.

20 Claims, 11 Drawing Sheets

(56) References Cited

U.S. PATENT DOCUMENTS

| | | | | |
|---|---|---|---|---|
| 6,684,455 | B1 * | 2/2004 | Mertin | E05D 11/087 16/328 |
| 6,948,217 | B2 * | 9/2005 | Higano | G06F 1/1616 16/303 |
| 6,988,294 | B2 * | 1/2006 | Birtley | E05D 11/087 16/337 |
| 7,107,649 | B2 * | 9/2006 | Nishihara | G06F 1/1616 16/303 |
| 7,143,476 | B2 * | 12/2006 | Minami | G06F 1/1616 16/340 |
| 2002/0083555 | A1 | 7/2002 | Suzuki | |
| 2004/0187260 | A1 | 9/2004 | Bruckner et al. | |
| 2014/0090204 | A1 * | 4/2014 | Sarnowski | E05D 3/02 16/340 |

FOREIGN PATENT DOCUMENTS

| | | | | |
|---|---|---|---|---|
| FR | 2788551 | A1 * | 7/2000 | E05D 11/087 |
| JP | 2004116540 | A * | 4/2004 | |
| JP | 2006250212 | A * | 9/2006 | |
| JP | 2008003247 | A * | 1/2008 | |
| RU | 2006695 | C1 * | 1/1994 | E05D 11/087 |

* cited by examiner

SELF-CONTAINED DOOR HINGE MECHANISM

FIELD

The present disclosure is generally directed to hinges, in particular, toward self-contained vehicle panel access hinges.

BACKGROUND

In recent years, transportation methods have changed substantially. This change is due in part to a concern over the limited availability of natural resources, a proliferation in personal technology, and a societal shift to adopt more environmentally friendly transportation solutions. These considerations have encouraged the development of a number of new flexible-fuel vehicles, hybrid-electric vehicles, and electric vehicles.

While these vehicles appear to be new they are generally implemented as a number of traditional subsystems that are merely tied to an alternative power source. In fact, the design and construction of the vehicles has been limited to standard frame sizes, shapes, materials, and transportation concepts. Among other things, these limitations fail to take advantage of the benefits of new technology, power sources, and support infrastructure.

In most cases, the new vehicles do not require a number of the systems or components associated with conventional vehicle technology. In particular, many electric vehicles do not employ parts that are necessary to support a gasoline-powered infrastructure including, for example, engines, multi-speed transmissions, catalytic converters, exhaust systems, oil pumps, gas pumps, water pumps, etc. These parts and systems add significant weight, complexity, and safety concerns that are not found in electric vehicles. As can be appreciated, the overall design of a new electric vehicle can be significantly different from that of conventional vehicles.

DETAILED DESCRIPTION

Figure 1:
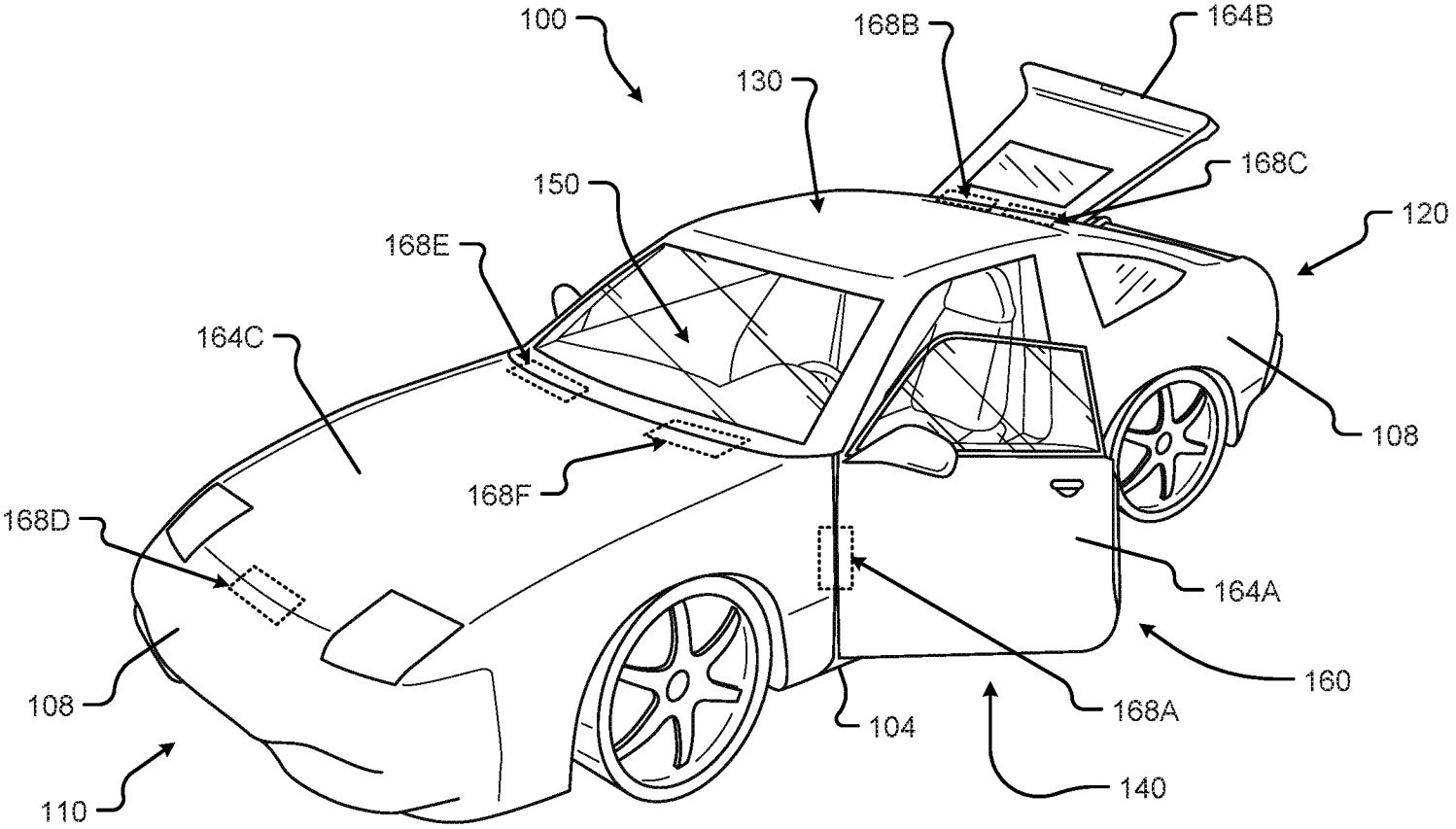
FIG. 1 shows a vehicle in accordance with embodiments of the present disclosure.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in conjunction with one embodiment, it is submitted that the description of such feature, structure, or characteristic may apply to any other embodiment unless so stated and/or except as will be readily apparent to one skilled in the art from the description.

Embodiments of the present disclosure will be described in connection with a door hinge or set of door hinges on a body closure or opening aperture that contains all of the hardware for movement feel and behavior within the hinge package space. Among other things, the self-contained hinge mechanism described herein can eliminate the need for a separate or external door movement mechanism (e.g., check strap, strut, and/or strut systems, etc.) while providing the same or even enhanced behavior characteristics over conventional hinge mechanisms.

In some embodiments, the behavior of the self-contained hinge mechanism may be adjusted or configured to provide a defined movement behavior based on the particular hinge movement control assembly employed therein. In other words, the hinge movement control assembly may include a number of components that, when arranged inside a hinge housing, provide a particular type of movement for the hinge and/or resistance to opening. A first movement control assembly may include a series of stacked elements that provide continuous rotational friction over a total angular movement range of the hinge. In one embodiment, the series of stacked elements may be forced toward one another via a force member (e.g., a spring, actuator, piston, pneumatic or hydraulic cylinder, inflatable bladder, etc.) disposed on each side of the stacked elements. The hinge including the first movement control assembly may be referred to herein as the "infinite friction" hinge. A second movement control assembly may include a gear reduced detent mechanism. This mechanism may provide at least one cam ring captured between two or more cam and/or detent disks. As the cam ring is rotated relative to the cam disks, a cam feature of the cam ring may follow at least one cam surface of the cam disks, or vice versa. Similar, if not identical, to the first movement control assembly, a force member may be disposed adjacent to each side of the cam ring and in contact with the cam disks.

It is an aspect of the present disclosure that the first movement control assembly may be replaced by the second movement control assembly to adjust, alter, or otherwise change the movement behavior of the self-contained hinge. In some embodiments, the self-contained hinge may include a number of modular components (e.g., shaft, housing, retaining elements, mount brackets, etc.) that allow for the quick replacement of one hinge movement control assembly for another. This modular design allows for hinges to employ a number of common components, bolt patterns, mounting locations, etc., while simultaneously offering an unlimited number of possible movement behaviors. For instance, the same self-contained hinge may receive any number of hinge movement control assemblies configured to provide a specific movement behavior for the hinge. As can be appreciated, the hinge movement control assemblies are in no way limited to the first and second movement control assemblies described herein, and may include any number of features configured to define a specific hinge movement behavior.

In some embodiments, the infinite friction, or friction-controlled, hinge mechanism may provide a fully tunable and adjustable hinge friction, without requiring any closure detent positions. For example, throughout the swing of the closure a user would experience a consistent movement feel, and the closure would remain in a position set by the user. Conventional closures may include a limited number of holding positions (e.g., three predetermined holding positions). At least one benefit of the infinite friction hinge is the ability of the hinge to hold a door relative to a frame at any number (e.g., an infinite number) of holding positions.

In one embodiment, an opening closure (e.g., door) may be attached to the hinge and another portion of the hinge may be rigidly mounted (e.g., to a body, frame, etc.). As the door opens/closes, the internal shaft of the hinge may be fixed to the door, body, or any other object providing a reference frame (e.g., via a bracket or other member etc.) such that moving the door moves a set of friction rings rotationally-locked to the internal shaft in unison with the door movement. The friction rings, while rotationally-locked, may be free to move axially along the internal shaft via one or more axial grooves running along an axial length of the shaft. A housing fixed to the body, or any other object providing a reference frame, may include a set of pressure disks rotationally-locked to the housing. The pressure disks, while rotationally-locked, may be free to move axially along axial guides disposed in the housing. Force members may act upon the outermost pressure disks of the hinge movement control assembly compressing the stack of pressure disks and friction rings together toward an axial center of the hinge. The force from the force members (e.g., compression springs, linear actuators, pistons, pneumatic or hydraulic cylinders, inflatable bladders, etc.) presses the pads against each disk, creating a friction force, or a resistance to torque about the hinge axis.

FIG. 1 shows a perspective view of a vehicle 100 in accordance with embodiments of the present disclosure. The vehicle 100 comprises a vehicle front 110, vehicle aft 120, vehicle roof 130, at least one vehicle side 160, a vehicle undercarriage 140, and a vehicle interior 150. In some embodiments, the vehicle 100 may include a frame 104 and one or more body panels 108 mounted or affixed thereto. The vehicle 100 may include one or more interior components (e.g., components inside an interior space 150, or user space, of the vehicle 100, etc.), exterior components (e.g., components outside of the interior space 150, or user space, of a vehicle 100, etc.), drive systems, controls systems, structural components, etc.

Although shown in the form of a car, it should be appreciated that the vehicle 100 described herein may include any conveyance or model of a conveyance, where the conveyance was designed for the purpose of moving one or more tangible objects, such as people, animals, cargo, and the like. The term "vehicle" does not require that a conveyance moves or is capable of movement. Typical vehicles may include but are in no way limited to cars, trucks, motorcycles, busses, automobiles, trains, railed conveyances, boats, ships, marine conveyances, submarine conveyances, airplanes, space craft, flying machines, human-powered conveyances, and the like.

The vehicle 100 may include a number of doors, hatches, hoods, trunks, panels, access openings, etc., and/or combinations thereof. By way of example, the vehicle 100 may include a first panel 164A configured to hingedly, or pivotally, open and/or close about a first hinge area 168A. The first panel 164A may be disposed at or near the at least one vehicle side 160. The first panel 164A may correspond to a vehicle door that, when opened, allows access to an interior space 150 of the vehicle 100. Additionally or alternatively, the vehicle may include a second panel 164B configured to hingedly open and/or close about a second and/or third hinge area 168B, 168C. The second panel 164B may correspond to a trunk or boot of a vehicle 100. The second panel 164B may be disposed at or near the vehicle aft 120. In some embodiments, opening the second panel 164B may provide access to a space physically separated (e.g., a separate compartment, storage volume, motor access area, battery storage area, maintenance access area, etc.) from the interior space 150 of the vehicle. In one embodiment, opening the second panel 164B may provide access to the interior space 150 of the vehicle. In some embodiments, the vehicle 100 may include a third panel 164C configured to hingedly open and/or close about a fourth hinge area 168D, or alternatively, about a fifth and/or sixth hinge area 168E, 168F. The third panel 164C may correspond to a hood or bonnet of a vehicle 100 that, when opened, provides access to a storage area, maintenance area, or a portion of the interior space 150 of the vehicle 100. The third panel 164C may be disposed at or near the vehicle front 110.

The hinge areas 168A-168F may correspond to mount locations about a vehicle 100 for one or more self-contained hinge mechanisms as described herein. In some embodiments, a first portion of the self-contained hinge mechanism may attach to a rigid portion of the vehicle 100 (e.g., frame 104, body panel 108, etc.) and a second portion of the self-contained hinge mechanism may attach to a portion of a panel 164A-164C. In any event, the panel 164A-164C may move relative to the vehicle 100 via a pivoting, or hinged, angular movement provided by the self-contained hinge mechanism disposed at a hinge area 168A-168F.

It should be appreciated that the hinge areas 168A-168F and the corresponding panels 164A-164C shown in FIG. 1 are provided as examples of mount locations and/or hinge points for embodiments of the self-contained hinge described herein and are not intended to limit the scope of the disclosure. For instance, the self-contained hinge described herein may be used at any hinged opening for any access panel.

Figure 2A:
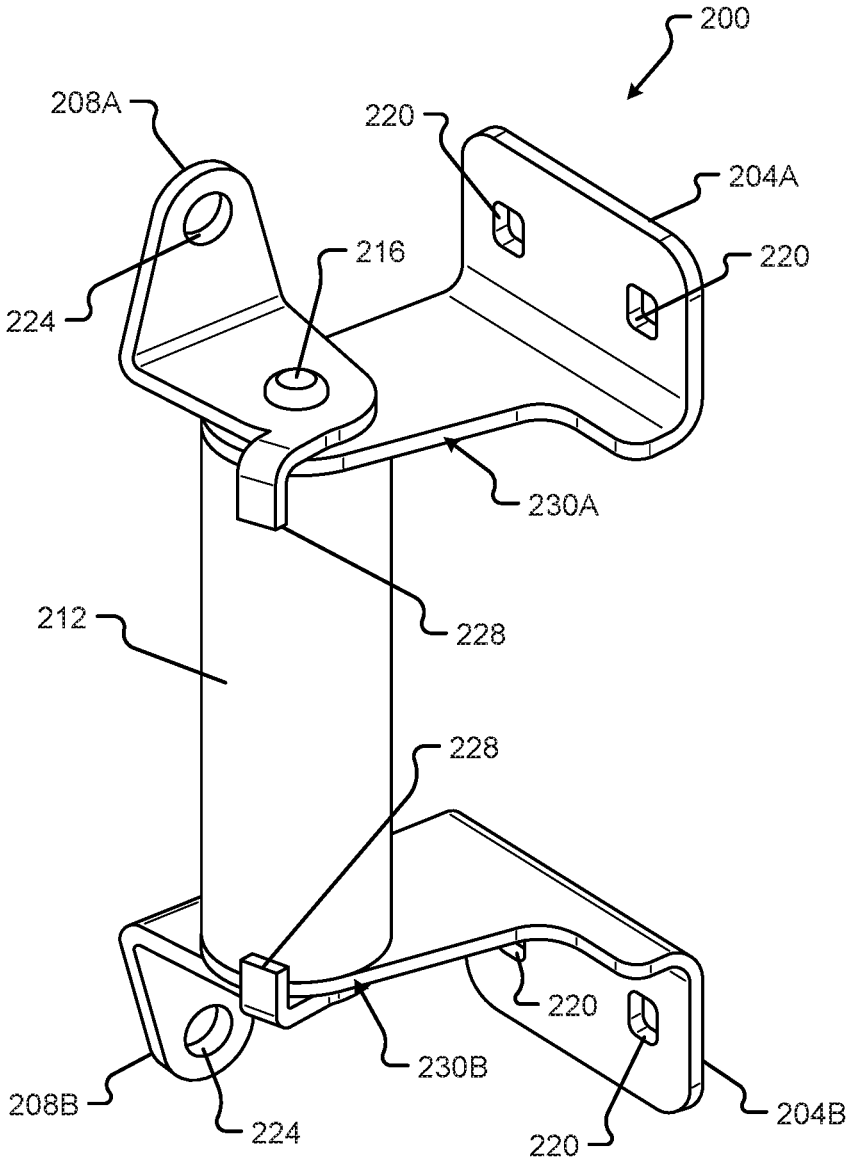
FIG. 2A is a perspective view of a self-contained hinge mechanism in accordance with embodiments of the present disclosure.
Figure 2B:
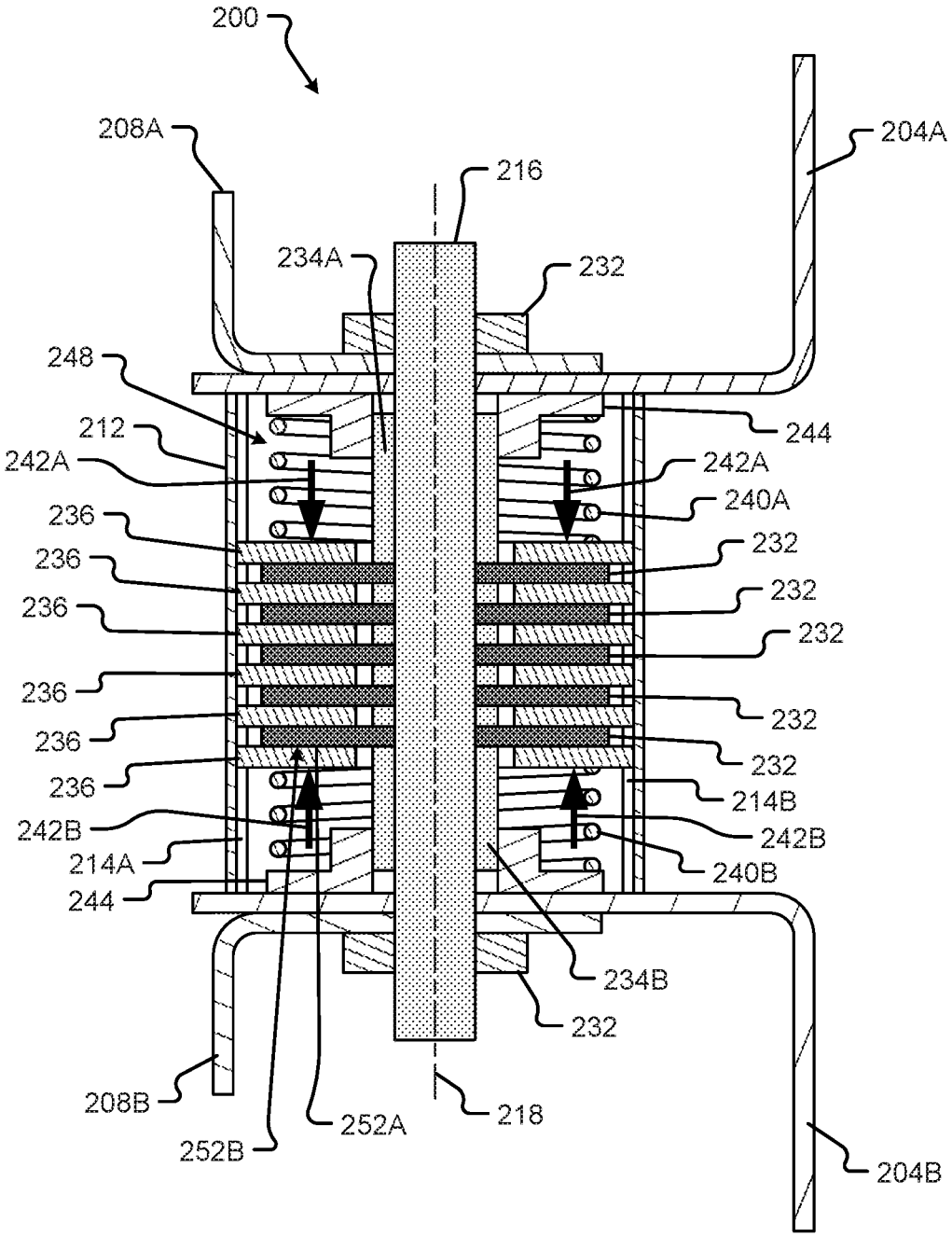
FIG. 2B is a section view of a self-contained hinge mechanism in accordance with embodiments of the present disclosure.
Figure 2C:
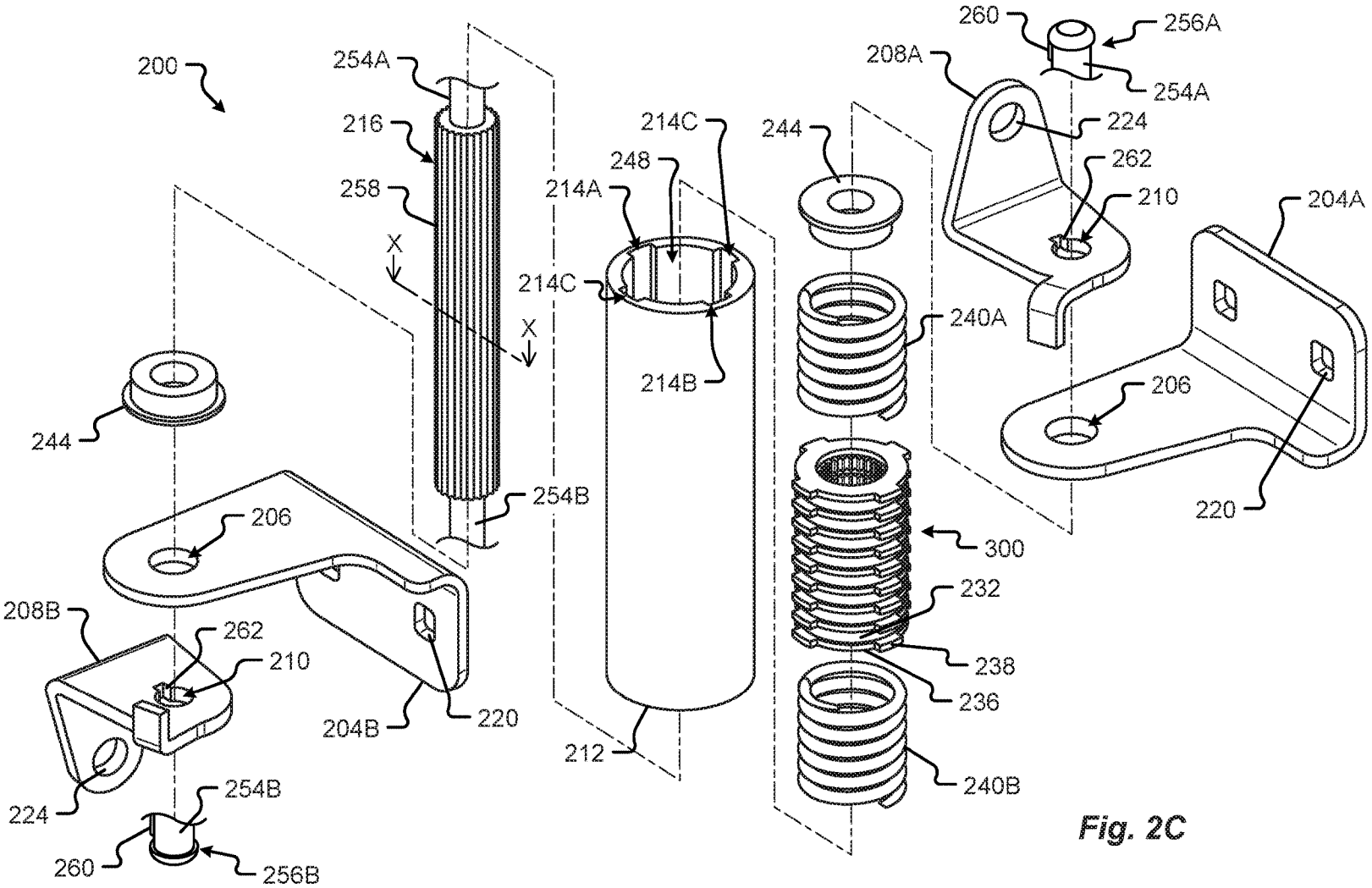
FIG. 2C is an exploded perspective view of a self-contained hinge mechanism in accordance with embodiments of the present disclosure.

The self-contained hinge mechanism 200 will now be described with reference to FIGS. 2A-2F. FIG. 2A shows a perspective view of the self-contained hinge mechanism 200. FIG. 2B shows a section view of the self-contained hinge mechanism 200 in accordance with embodiments of the present disclosure. The sections shown in FIGS. 2B and 2D may be taken, for example, through a center of the hinge mechanism 200. In some embodiments, the components contained within at least a portion of the housing 212 may be centerline symmetrical about the shaft, or central, axis 218. FIG. 2C shows an exploded perspective view of the self-contained hinge mechanism 200 in accordance with embodiments of the present disclosure.

The self-contained hinge mechanism 200 may comprise a first frame bracket 204A and a second frame bracket 204A offset, or spaced apart, by a housing 212. In some embodiments, the housing 212 may be affixed to the first and/or second frame bracket 204A, 204B. For example, the housing 212 may be glued, welded, fastened, fused, keyed, connected, or otherwise locked with the first and/or second frame bracket 204A, 204B. In one embodiment, the housing 212 may be formed as part of the first and/or second frame bracket 204A, 204B. In any event, the housing 212 may be rotationally-locked relative to one or more of the frame brackets 204A, 204B.

The frame brackets 204A, 204B may be mounted to a rigid surface or structure (e.g., a vehicle frame 104, body panel 108, etc.) via one or more frame bracket mounting features 220. In some embodiments, the frame bracket mounting features 220 may be configured as holes, through which a fastener may be inserted thereby affixing the frame bracket 204A, 204B to the rigid structure. Examples of the fastener may include, but are in no way limited to, a screw, bolt, carriage bolt, rivet, pin, threaded rod, stud, etc., and/or combinations thereof. The hole may be a substantially circular hole, square hole, bushing, captured or captive nut, threaded hole, etc., and/or combinations thereof. In some embodiments, the frame bracket mounting features 220 may include a captured or captive screw, protrusion, stud, and/or other feature configured to extend from the frame bracket 204A, 204B and interconnect with a receiving feature (e.g., mating feature, hole, etc.) disposed on the rigid surface (e.g., the frame 104, body panel 108, etc.).

The self-contained hinge mechanism 200 may include a first door bracket 208A and a second door bracket 208B. In some embodiments, the door brackets 208A, 208B may be made up of a number of different brackets, plates, extrusions, bendments, weldments, or other structural members assembled together or otherwise affixed to one another. In one embodiment, the door brackets 208A, 208B when assembled together may form a single unified structure. The door brackets 208A, 208B may be configured to mount to a movable panel (e.g., a door) via one or more door bracket mounting features 224. In some embodiments, the door bracket mounting features 224 may be configured as holes, through which a fastener may be inserted thereby affixing the door bracket 208A, 208B to the movable panel. Examples of the fastener may include, but are in no way limited to, a screw, bolt, carriage bolt, rivet, pin, threaded rod, stud, etc., and/or combinations thereof. The hole may be a substantially circular hole, square hole, bushing, captured or captive nut, threaded hole, etc., and/or combinations thereof. In some embodiments, the door bracket mounting features 224 may include a captured or captive screw, protrusion, stud, and/or other feature configured to extend from the door bracket 208A, 208B and interconnect with a receiving feature (e.g., mating feature, hole, etc.) disposed on the movable panel (e.g., the door 164A, the trunk or boot 164B, the hood or bonnet 164C, etc.).

In some embodiments, the door brackets 208A, 208B may be configured to rotate relative to the frame brackets 204A, 204B. The door brackets 208A, 208B may include a door bracket stop 228. The door bracket stop 228 may limit an angular range of travel of the hinge 200. For instance, the door bracket stop 228 may prevent a rotational movement of the door brackets 208A, 208B past a predefined stop point. In one embodiment, the door bracket stop 228 may be configured as a bent tang or other feature of the door bracket 208A, 208B. In this example, as the movable panel is hingedly rotated, the door brackets 208A, 208B and door bracket stop 228 moves about a central axis of the hinge shaft 216 until the door bracket stop 228 contacts a stop surface 230A, 230B. The stop surfaces 230A, 230B may correspond to at least one surface or feature of the frame brackets 204A, 204B, respectively. The predefined stop point may correspond to the largest angular opening range defined by the limits of the hinge 200 for the movable panel. For instance, a vehicle door 164A may have a fully-open position which is defined, or limited, by the arrangement of the door bracket stops 228 and the stop surfaces 230A, 230B. In some cases, the door bracket stop 228 may be configured to provide a safety limit for the angular range of the hinge 200. By way of example, the hinge 200 may include one or more other angular limit features (e.g., detents, cam dwell areas, etc.) built into the hinge movement control assembly, and if the movable panel is forced past these built-in angular limit features, the hinge 200 may be restricted from further angular movement by the door bracket stop 228. In this case, the door bracket stop 228 may act as a safety feature to prevent overextension, over-rotation, or over-travel of the door past acceptable and/or predefined limits (e.g., the built-in angular limits, etc.).

As shown in FIG. 2B and as described above, the housing 212 may be interconnected with the first frame bracket 204A and/or the second frame bracket 204B such that the housing 212 is rotationally-locked, or fixed, relative to the first and/or second frame brackets 204A, 204B. In some embodiments, the housing 212 may be configured as a tube or hollow shaft comprising an external diameter defining an outer wall of the housing 212 and an internal diameter defining an inner wall of the housing 212. Although shown as a substantially cylindrical hollow shape, it should be appreciated that the housing 212 may be any shape (e.g., square, oval, polygonal, etc., and/or combinations thereof) capable of receiving and/or containing the internal components of the hinge mechanism 200.

The housing 212 may include one or more axial translation guides 214A-214D running along an axial length of the housing 212. In some cases, the axial translation guides 214A-214D may correspond to machined, cut, broached, or otherwise formed guide channels disposed in a portion of the housing 212. For example, the first axial translation guide 214A may provide a channel, or keyway, guide feature having a depth inside the wall of the housing 212. The depth may extend in a direction from the inside wall of the housing 212 radially outward (e.g., toward the outer wall of the housing 212), for instance, without breaking through the outer wall of the housing 212. Each of the axial translation guides 214A-214D may be configured to receive a corresponding mating feature, or location tab, 238 (e.g., a tab, tang, or other protrusion, etc.) of at least one pressure disk 236. The axial translation guides 214A-214D may be sized to accommodate the location tabs 238 with a slip fit or loose tolerance. Among other things, this slip fit allows the pressure disks 236 to translate, or move, axially along a portion of the housing 212 while simultaneously locking the rotation of each pressure disk 236 relative to the housing 212. In other words, the pressure disks 236 are rotationally locked to the housing 212 via the location tab 238 protrusion of the pressure disk 236 extending into a portion of the axial translation guides 214A-214D. Each of the pressure disks 236 include a through hole disposed substantially in the center of the pressure disk 236. The through hole may be sized having a diameter that ensures clearance for the shaft 216, such that the shaft 216 does not contact the pressure disk 236 or any portion of the through hole when the self-contained hinge mechanism 200 is fully assembled.

The self-contained hinge mechanism 200 may include a number of components disposed at least partially within an internal volume or space 248 of the housing 212. These components may include the hinge shaft 216, shaft sleeves 244, force members 240A, 240B, friction rings 232, and pressure disks 236. As provided above, the shaft 216 may be fixedly attached to at least one of the first door bracket 208A and/or the second door bracket 208B. This attachment rotationally locks the shaft 216 to at least one of the first door bracket 208A and/or the second door bracket 208B. In other words, as the door brackets 208A, 208B rotate or move about the center axis 218 of the hinge mechanism 200 and relative to the frame brackets 204A, 204B, the shaft 216 moves along with the door brackets 208A, 208B. Examples of the rotational lock attachment can include, but is in no way limited to, welding the shaft 216 to at least one of the door brackets 208A, 208B, fitting the shaft 216 and a locking feature disposed on the shaft into a corresponding locking feature in at least one of the door brackets 208A, 208B (e.g., key-and-keyway, tab-and-slot, mortise-and-tenon, spline-and-groove, interference fit, etc., and/or combinations thereof), forming a portion of the shaft 216 into a portion of at least one of the door brackets 208A, 208B and/or vice versa.

The shaft 216 may comprise a first shaft end 256A, a second shaft end 256B, and a shaft body section 258 disposed therebetween. In some embodiments, a number of axial translation grooves 234 may be disposed around a periphery of the shaft body section 258. These axial translation grooves 234 may extend along a complete length of the shaft body section 258. In one embodiment, the axial translation grooves 234 and shaft body section 258 may correspond to a splined section of the shaft 216. The axial translation grooves 234 may be configured to mate with corresponding features on a friction ring 232. For example, the friction ring 232 may be structured similarly to a flat washer or flat ring having in inner diameter, an outer diameter, and a certain thickness. In this example, the friction ring 232 may include the mating groove features on the inner diameter along the thickness of the friction ring 232. Once a friction ring 232 is placed onto the shaft 216 and the mating groove features engage with the axial translation grooves 234 of the shaft body section 258, the friction ring 232 is prevented from rotating relative to the shaft 216. Although each friction ring 232 may translate, or move, axially along a portion of the shaft body section 258, the friction rings 232 are rotationally locked to the shaft 216 via the grooved engagement. In other words, the grooved engagement of the friction rings 232 to the shaft body section 258 allows the friction rings 232 to rotate in unison, or together, with rotation of the shaft 216. As can be appreciated, as the door brackets 208A, 208B are rotated relative to the frame brackets 204A, 204B, the rotation moves the shaft 216 and friction rings together relative to the frame brackets 204A, 204B.

In some embodiments, the shaft 216 may include a turned, stepped, or reduced diameter portion extending beyond the shaft body section 258 at one or more of the shaft ends 256A, 256B. In one embodiment, these extensions 254A, 254B may be inserted into, or formed as part of, the shaft 216. In any event, the extensions 254A, 254B may include the anti-rotation locking features 260, described above, keying the shaft 216 to at least one of the door brackets 208A, 208B. For example, the anti-rotation locking features 260 may key, or positively locate, with a corresponding bracket anti-rotation shaft locking feature 262 disposed in at least one of the door brackets 208A, 208B. The extensions 254A, 254B may extend from an internal space 248 of the housing 212 through a bracket clearance hole 206 disposed in the frame brackets 204A, 204B and into a shaft hole 210 disposed in the door brackets 208A, 208B. The bracket clearance hole 206 may be sized to accommodate the largest diameter of the shaft 216 (e.g., at the shaft body section 258), such that the shaft 216 can be inserted through the bracket clearance hole 206 (e.g., during assembly and/or disassembly, etc.). In some cases, the bracket clearance hole 206 may be sized to accommodate the shaft extensions 254A, 254B and the anti-rotation locking features 260, such that the shaft extensions 254A, 254B and the anti-rotation locking features 260 can be inserted through the bracket clearance hole 206 during assembly and/or disassembly.

The shaft 216 may be held in radial alignment in the self-contained hinge mechanism 200 via one or more sleeves 244. The sleeves 244 may be disposed in the internal space 248 of the housing 212. In some embodiments, the sleeves 244 may be attached to the frame brackets 204A, 204B and/or the housing 212. The sleeves 244 may be configured as a bushing or bearing allowing low friction rotation of the shaft 216 relative to the frame brackets 204A, 204B and/or the housing 212. In some embodiments, the sleeves 244 may be threaded and may be adjusted to increase or decrease a height of the force members 240A, 240B inside the hinge mechanism 200. In some cases, this adjustment may provide a compression of the force members 240A, 240B, increasing a rotational resistance of the hinge mechanism 200. It is an aspect of the present disclosure, that the threaded interfaces and/or other adjustments to the force members 240A, 240B disclosed herein may be employed to fine-tune a friction of the hinge mechanism at manufacturing, maintenance, repair, etc., such that each hinge mechanism 200 can have identical and/or consistent force between hinge mechanisms 200. This adjustment and fine-tuning provides a high quality hinge mechanism feel providing consistent, repeatable, rotational movement between hinge mechanisms 200 and vehicles 100, etc.

In some embodiments, the shaft 216 may be held in axial alignment in the self-contained hinge mechanism 200 via one or more shaft retainers 232. The shaft retainers 232 may comprise a collar, split-collar, nut, pin, or other retaining element that is attached to the shaft 216. In one embodiment, the shaft retainers 232 may be a formed portion of the shaft 216 such as a head, flange, or other feature, welded to or, formed at one or more of the shaft ends 256A, 256B.

In one embodiment, the reduced diameter of the shaft 216 at the shaft ends 256A, 256B may provide substantially flat surfaces at a point along the shaft 216 where the shaft extensions 254A, 254B meet the shaft body section 258. These surfaces may be captured between the frame brackets 204A, 204B, such that in an assembled state, the shaft 216 is held in axial alignment in the self-contained hinge mechanism 200 via the surfaces contacting a bearing surface of the mechanism 200.

The self-contained hinge mechanism 200 may include force members 240A, 240B configured to apply force to each side of a hinge movement control assembly 300. In some embodiments, this force may be applied against the outermost pressure disks 236 bracketing the components of the hinge movement control assembly 300. The forces may be applied in directions 242A, 242B toward one another. These opposing forces provide a compressive, or clamping, pressure force to the elements in the hinge movement control assembly 300. Examples of force members 240A, 240B may include, but are in no way limited to, compression springs, die springs, Belleville washers, disk springs, linear actuators, pistons, pneumatic or hydraulic cylinders, inflatable bladders, solenoids, etc., and/or combinations thereof. While shown as spring elements in FIGS. 2B and 2C, it should be appreciated that the force members 240A, 240B may comprise any element, device, or mechanism configured to apply a pressure force to the elements in the hinge movement control assembly 300.

As described above, the movement and/or operational behavior of the self-contained hinge mechanism 200 may be controlled in part by the interaction of the components in the hinge movement control assembly 300. The hinge movement control assembly 300 shown in FIGS. 2B-3B, includes a plurality of alternating stacked pressure disks 236 and friction rings 232. This alternating arrangement of disks 236 and rings 232 in the hinge movement control assembly 300 provides friction surfaces of the friction rings 232 sandwiched between contact surfaces of the pressure disks 236. In other words, each of the sandwiched friction rings 232 contacts one of the pressure disks 236 on a first side of the pressure ring 232 at a first pressure contact area 252A and contacts another of the pressure disks 236 on the opposite, or second, side of the pressure ring 232 at a second pressure contact area 252B. The friction, or resistance to rotational motion, at the pressure contact areas 252A, 252B may be controlled or set based on an amount of force provided by the force members 240A, 240B. In some cases, the force members 240A, 240B may be configured to provide a specific constant force against the disks 236 and rings 232 when assembled in the mechanism 200 (e.g., springs having definite spring constants, piston, gas bladders, etc.). In some instances, the force may be adjusted (e.g., increased and/or decreased) by adjusting an installed compression of the force members 240A, 240B. Additionally or alternatively, the force members 240A, 240B may provide a variable force against the disks 236 and rings 232 when assembled in the mechanism 200. The variable force may be controlled, for example, by increasing and/or decreasing a force exerted by the force members 240A, 240B against the outermost pressure disks 236 in the hinge movement control assembly 300 (e.g., moving a portion of a linear actuator toward and/or away from the pressure disks 236, inflating and/or deflating a portion of an internal bladder, moving a portion of the members 240A, 240B closer to and/or further from the outermost pressure disks 236, etc., respectively).

Figure 2D:
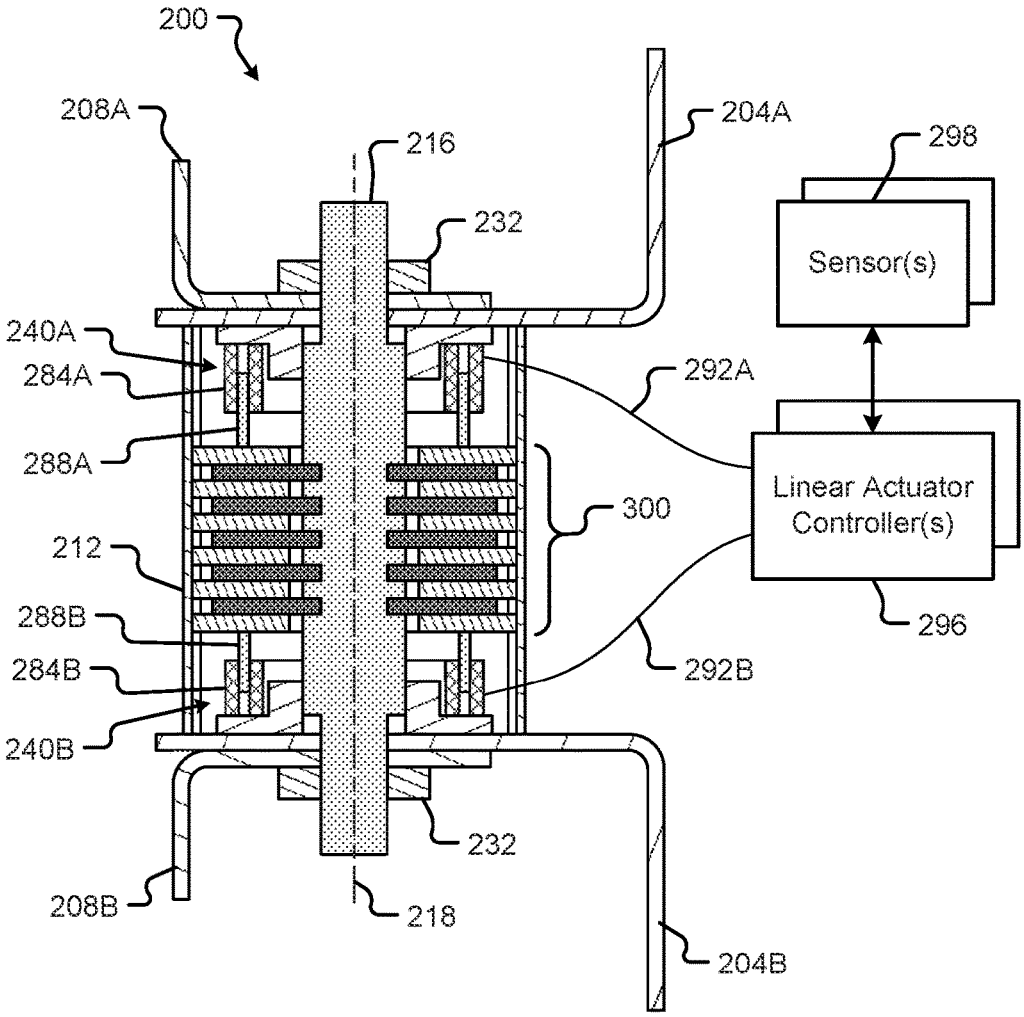
FIG. 2D is a section view and schematic diagram of a self-contained hinge mechanism and controller in accordance with embodiments of the present disclosure.

As provided above, the force members 240A, 240B may be linear actuators (e.g., solenoid actuators, screw actuators, gas actuators, air cylinders, hydraulic cylinders, etc., and/or combinations thereof). FIG. 2D shows a schematic diagram of a hinge mechanism 200 including linear actuator force members 240A, 240B and corresponding motion and/or force controllers 296. Each of the linear actuator force members 240A, 240B may be connected to a linear actuator controller 296 via at least one supply line 292A, 292B. The supply lines 292A, 292B may correspond to electrical wires, conductors, traces, signal lines, pneumatic lines, hydraulic lines, etc., and/or combinations thereof. In some embodiments, the linear actuator controller 296 may comprise a microprocessor, a computer readable medium, and instructions stored on the computer readable medium configured to receive information from one or more sensors 298 of the vehicle 100 and/or the hinge mechanism 200 and provide a control signal to the linear actuator force members 240A, 240B via the supply lines 292A, 292B. In some embodiments, the linear actuator force members 240A, 240B may provide positional and/or force feedback of each linear actuator force member 240A, 240B (e.g., via the supply lines 292A, 292B, etc.) to the linear actuator controllers 296. In one embodiment, the linear actuator force members 240A, 240B may include a body 284A, 284B and a movable element 288A, 288B (e.g., a plunger, piston, extension, etc.). In some cases, the linear actuator force members 240A, 240B may be configured as a movable annulus or ring through which at least some of the internal components of the hinge mechanism 200 may pass. The movable element 288A, 288B may be is configured to move relative to the body 284A, 284B when actuated (e.g., energized, powered, etc.). This movement toward the outermost elements of the hinge movement control assembly 300 may provide a compressive force and a friction for the hinge mechanism 200 designed to resist rotational movement of the door bracket 208A, 208B relative to the frame brackets 204A, 204B, etc.

In any event, the force applied by these linear actuator force members 240A, 240B may be selectively controlled. For instance, a controller of the vehicle 100 may determine to apply a force, via the linear actuator force members 240A, 240B, on the elements comprising the hinge movement control assembly 300 at a particular time. By way of example, when a vehicle door 164A is closed (e.g., in a closed and/or locked state, etc.) the linear actuator force members 240A, 240B may be in an unactuated or inactive state. If the linear actuator force members 240A, 240B are solenoid actuators, for example, then the solenoid of the solenoid actuators may be de-energized or turned off (e.g., when no movement current is supplied to the solenoid) when the door is closed. However, once the vehicle door 164A is opened, the controller may determine (e.g., via a door open sensor, an actuation handle sensor, a door handle sensor, etc.) to energize the solenoid (e.g., providing movement current to the solenoid) and provide the force necessary to compress the hinge movement control assembly 300 and at least partially restrict rotational movement of the hinge mechanism 200. In one embodiment, the force applied by the linear actuators may be adjusted (e.g., via the controller, etc.) at various angular opening points, or over a range of angular opening points. For instance, as the vehicle door 164A is opened further (i.e., at an increasing angular range from the vehicle frame 104 or body panel 108, the force output by the linear actuators may be increased over the angular range of travel. In some cases, the linear actuator may be controlled to provide a stopping force at a predetermined fully-open position for the vehicle door 164A. This stopping force may clamp all of the elements in the hinge movement control assembly 300 such that the vehicle door 164A is incapable of moving past the fully-open position, essentially locking the vehicle door 164A in the fully-open position.

Figure 2E:
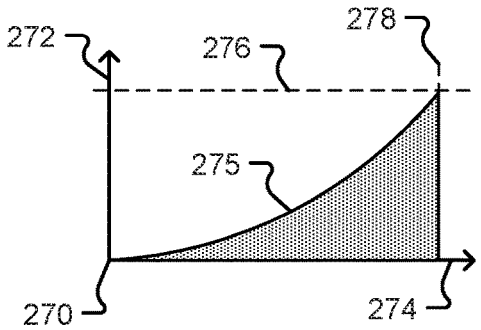
FIG. 2E shows a graphical representation of a linear actuator force control output over angular translation range in accordance with embodiments of the present disclosure.
Figure 2F:
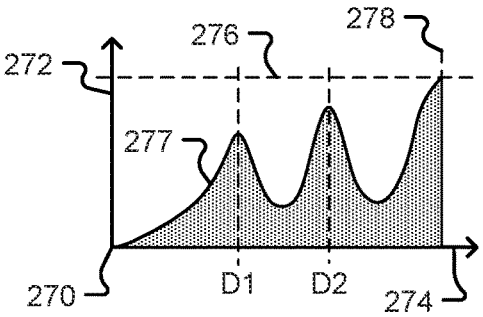
FIG. 2F shows a graphical representation of a linear actuator force control output over angular translation range in accordance with embodiments of the present disclosure.

FIGS. 2E and 2F show graphical representations of controlled output force for a linear actuator force member 240A, 240B as the hinge mechanism 200 is rotated from a closed position to an open position. As shown in FIGS. 2E and 2F, the force output over angular range 275, 277 may include varying levels of intensity or measurement units along the vertical axis 272 for one or more angular positions in the horizontal axis 274. The first hinge position 270 may correspond to a door closed position. The maximum hinge position 278 may correspond to a fully-open position for a vehicle door 164A. At the first hinge position 270 the linear actuator force members 240A, 240B of the hinge mechanism 200 are unactuated, or providing no force upon the hinge movement control assembly 300. At the maximum hinge position 278 the linear actuator force members 240A, 240B of the hinge mechanism 200 are actuated and providing a stopping force clamping the hinge movement control assembly 300 such that the hinge mechanism 200 and/or the components thereof are incapable of moving rotationally. As shown in FIG. 2E, the controller 296 may provide a smooth or increasing application of force as the hinge mechanism 200 is moved from a closed position (e.g., the first hinge position 270) to a fully-open position (e.g., the maximum hinge position 278), and vice versa. Additionally or alternatively, the controller 296 may provide a variable force output for the linear actuator force members 240A, 240B at preset angular hinge positions (e.g., D1, D2, etc.), as shown in FIG. 2F. This control of the linear actuator force members 240A, 240B may allow for virtual detents D1, D2, etc., at one or more angular positions of hinge rotation. In some embodiments, each virtual detent position D1, D2 may include same or different maximum actuation forces, dwells, etc.

Other sensors 298 may be associated with the vehicle door 164A and/or the hinge mechanism 200 configured to provide a signal to the linear actuator controller 296 when a user attempts to return the vehicle door 164A to a closed position, open the vehicle door 164A, and/or reposition the vehicle door 164A at any other angular position (e.g., past the fully-open position, etc.). These sensors 298 may include, but are in no way limited to, a strain gauge, pressure transducer, or other sensor. The sensors 298 may be configured to detect when a user applies a force to the vehicle door 164A. As can be appreciated, an opening force applied by a user may include at least one strain measurement that is opposite a closing force applied by the user. Continuing the fully-open example provided above, a user may attempt to move the door 164A to a closed or reduced-open position from the fully-open state. Upon detecting the closing force (e.g., via the strain gauge and/or other sensor, etc.), the linear actuator controller 296 may send a control signal to the linear actuators 240A, 240B via the supply lines 292A, 292B to reduce the force applied by the linear actuators on the hinge movement control assembly 300 and the overall resistance to rotational movement for the hinge mechanism 200. This force may be controlled by the linear actuator controller 296 to, among other things, prevent slamming (e.g., by determining a closure force applied and an angular range of travel required to close the vehicle door 164A, etc.), provide even resistance to a user applied closing force, provide a soft-close of the vehicle door 164A, and/or otherwise control a rate of travel of the vehicle door 164A relative to the vehicle frame 104 and/or body panel 108.

The self-contained hinge mechanism 200 may include a rotationally fixed set of components and a rotationally moving set of components. Specifically, the rotationally moving set of components move relative to the rotationally fixed set of components when actuating the hinge mechanism 200. The rotationally fixed set of components may comprise the frame brackets 204A, 204B and housing 212. The rotationally fixed set of components may include a plurality of pressure disks 232 rotationally locked to the housing 212, but able to move in an axial direction of the hinge mechanism 200. In any event, these components may be fixed to, for instance, a vehicle frame 104, body panel 108, or other static portion of a vehicle 100. The rotationally moving set of components may comprise the components that move when the hinge mechanism 200 is actuated. For example, the rotationally moving set of components may include the door brackets 208A, 208B, shaft 216, and the friction rings 232. The operation of the hinge mechanism 200 may be described in conjunction with opening and/or closing the door 164A of a vehicle 100. As the door 164A of the vehicle 100 is opened, the door brackets 208A, 208B of the hinge mechanism 200 move pivotally relative to the frame 104 and the fixed frame brackets 204A, 204B. This pivotal movement causes the friction rings 232 rotationally-locked to the shaft 216 to rotate along with the door 164A (e.g., and the door brackets 208A, 208B and the shaft 216) relative to the vehicle frame 104 and the rotationally-locked pressure disks 236 captured in the housing 212 of the mechanism 200. Opposing forces provided from the force members 240A, 240B applied against the outermost pressure disks 236 of the hinge movement control assembly 300, and toward an axial center of the assembly 300, provide friction or a resistance to the rotation of the door 164A. This resistance to the rotation may be provided by the clamping force of the force members 240A, 240B moving the pressure disks 236 in the axial translation guides 214A-214D closer to one another and sandwiching the friction rings 232 closer together (e.g., where the friction rings 232 move along the axial translation grooves 234 in the shaft body section 258 toward the axial center of the assembly 300 and/or mechanism 200).

In some embodiments, the friction or resistance to rotation in the hinge movement control assembly may be increased by increasing a force applied by the force members 240A, 240B and/or by increasing the number of pressure disks 236 and friction rings 232 alternatively arranged in the hinge movement control assembly 300.

Figure 3A:
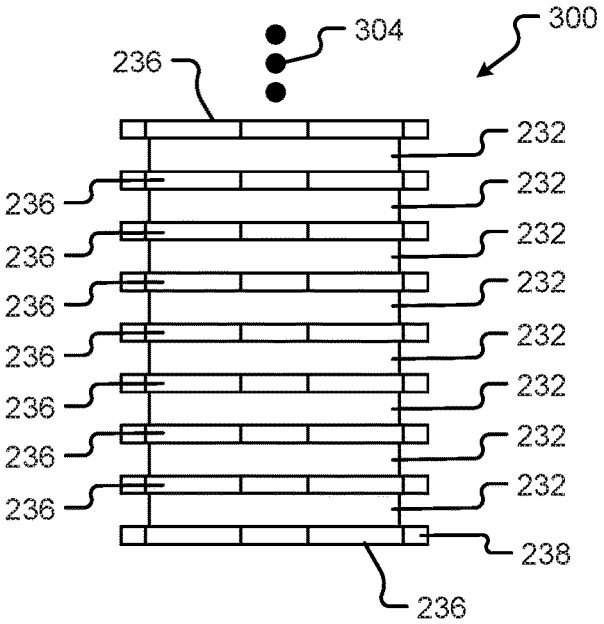
FIG. 3A is a side view of a hinge movement control assembly of a self-contained hinge mechanism in accordance with embodiments of the present disclosure embodiment.
Figure 3B:
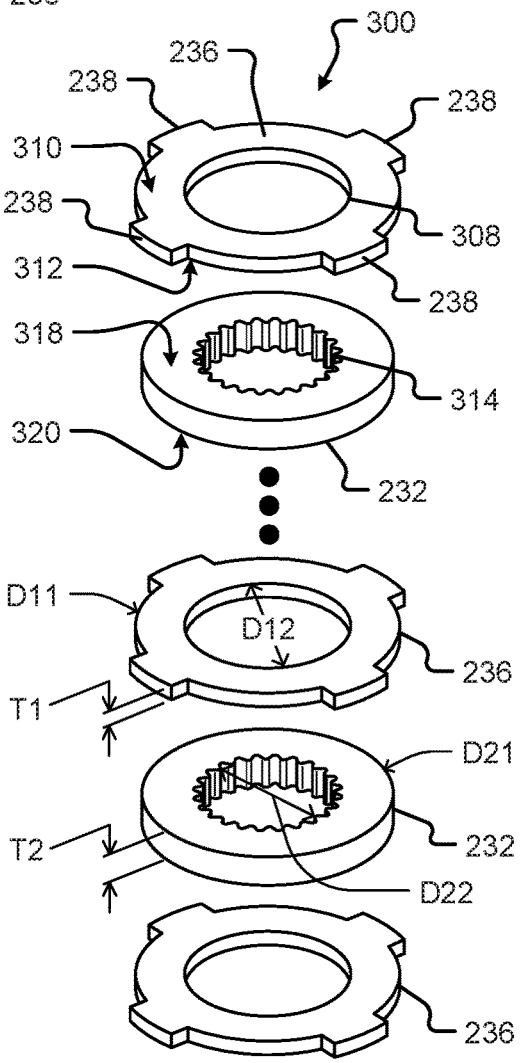
FIG. 3B is an exploded perspective view of the hinge movement control assembly of FIG. 3A.

FIG. 3A-3B show various views of a hinge movement control assembly 300 in accordance with embodiments of the present disclosure. The hinge movement control assembly 300 may include an alternating stack of pressure disks 236 and friction rings 232 and can include any number of elements. In one embodiment, the hinge movement control assembly 300 may include a number of pressure disks 236 and friction rings 232 captured between outermost pressure disks 236. The pressure disks 236 may be structured to contact force members 240A, 240B and transfer the force applied to the other friction rings 232 and pressure disks in the stack.

FIG. 3A shows a side view of a hinge movement control assembly 300 including nine pressure disks 236 and eight friction rings 232 arranged in an alternating stack of components. It should be appreciated that the hinge movement control assembly 300 may include more 304 or fewer components than represented in FIG. 3A. As provided above, the number of components in the stack may alter the resistance to rotation for the hinge mechanism 200. For example, the greater the number of pressure disks 236 and friction rings 232 in the assembly 300, the greater the resistance to rotation, or friction, for the hinge mechanism 200. Alternatively, fewer pressure disks 236 and friction rings 232 in the assembly 300 lowers the resistance to rotation, or friction, for the hinge mechanism 200. It is an aspect of the present disclosure that the friction (e.g., the frictional holding force, rotational resistance, etc.) of the hinge mechanism 200 may be configured, controlled, or otherwise set via one or more features described herein. For example, the pressure contact area 252A, 252B, or area of contact between friction rings 232 and pressure disks 236, may be increased in size to increase the friction of the hinge mechanism 200 or decreased in size to decrease the friction of the hinge mechanism 200. In some embodiments, the size or gauge of the spring (e.g., force members 240A, 240B) may be increased in thickness or diameter to increase the friction of the hinge mechanism 200 (e.g., creating a higher compressive force applied to the stack of disks 236 and rings 232 when compared to a smaller diameter spring gauge spring, etc.) or decreased in thickness or diameter to decrease the friction of the hinge mechanism 200. In one embodiment, the materials of the pressure disks 236 and/or the friction rings 232 may be selected with specific coefficients of friction configured to provide resistance to rotation or the friction of the hinge mechanism 200. In another example, the friction rings 232 and/or pressure disks 236 may include at least one surface (e.g., the surface disposed at the pressure contact area 252A, 252B, etc.) having an increased coefficient of friction than other surfaces of the rings 232 and/or disks 236 providing a greater frictional force and rotational resistance of the hinge mechanism 200.

In some embodiments, where the force members 240A, 240B may be compression springs, the friction and/or rotational resistance of the hinge mechanism 200 may be tuned by presetting a compression of the compression springs. In one embodiment, this tuning may be achieved by inserting one or more spacers between the frame bracket 204A, 204B and the springs and/or between the hinge movement control assembly 300 and the springs (e.g., compressing the springs at a compressed height, etc.). In some cases, this tuning may be adjusted via at least one spring support member disposed inside the hinge mechanism 200 threaded to a portion of the shaft sleeves 244 or other component of the hinge mechanism 200 and in supportive contact with a base of the spring. To increase the friction and/or rotational resistance of the hinge mechanism 200 the spring support member may be rotated about the threaded axis and tightened against the compression spring (e.g., decreasing a height of the compressed compression spring, etc.). To decrease the friction and/or rotational resistance of the hinge mechanism 200 the spring support member may be rotated about the threaded axis and loosened from the compression spring (e.g., increasing a height of the compressed compression spring, etc.).

Referring now to FIG. 3B, an exploded perspective view of the hinge movement control assembly 300 is shown in accordance with embodiments of the present disclosure. As illustrated in FIG. 3B, each of the pressure disks 236 may be structured as a substantially flat disk having a shaft clearance hole 308 passing from a first disk surface 310 through to a second disk surface 312 opposite and spaced apart from the first disk surface 310 by a thickness T1 of the pressure disk 236. The pressure disk 236 may comprise an outer diameter, D11, and an inner diameter corresponding to the diameter of the shaft clearance hole 308, D12. The diameter, D12 of the shaft clearance hole 308 may be sized larger than the outer diameter of the shaft 216 and the shaft body section 258. When the hinge mechanism is fully-assembled, a portion of the shaft 216 is positioned inside the shaft clearance hole 308 without directly contacting the pressure disk 236 and/or the shaft clearance hole 308. During operation of the hinge mechanism 200, the shaft 216 may move within the shaft clearance hole 308 without directly contacting the pressure disk 236 and/or the shaft clearance hole 308.

Each pressure disk 236 in the stack may include one or more location tabs 238 protruding outwardly from the outer diameter, D11, in a radial direction. In some embodiments, the location tabs 238 may be in a same plane as the first and/or second disk surfaces 310, 312. The location tabs 238 may be sized to slidably engage with the axial translation guides 214A-214D of the housing 212. Once installed in the internal space 248 of the housing 212 and engaged with the axial translation guides 214A-214D, the pressure disks 236 may be rotationally locked to the housing 212 but able to move, translate, or slide, in an axial direction (e.g., following the axial translation guides 214A-214D, etc.).

As shown in FIG. 3B, each of the friction rings 232 may be structured as a substantially flat disk or ring having a grooved hole 314 passing from a first ring surface 318 through to a second ring surface 320 opposite and spaced apart from the first ring surface 318 by a thickness T2 of the friction ring 232. The friction ring 232 may comprise an outer diameter, D21, and an inner root diameter D22 substantially matching, within axial slip-fit tolerances, the root diameter of the shaft body section 258. When the hinge mechanism 200 is fully-assembled, a portion of the shaft body section 258 is positioned inside the grooved hole 314 and each of the axial translation grooves 234 may interconnect, or mate, with corresponding complementary grooves in the grooved hole 314. In some embodiments, the grooved hole 314 may be a splined cut feature and the axial translation grooves 234 of the shaft 216 may have complementary spline features (e.g., a splined shaft, etc.). In some embodiments, the axial translation grooves 234 and the grooves in the grooved hole 314 may be dimensioned such that each friction ring 232 may slidably engage with the axial translation grooves 234 of the shaft 216. Once installed in the internal space 248 of the housing 212 and engaged with the axial translation grooves 234, the friction rings 232 are rotationally locked to the shaft 216 but able to move, translate, or slide, in an axial direction (e.g., following the axial translation grooves 234) of the shaft 216.

During operation of the hinge mechanism 200, as the shaft 216 is moved the friction rings 232 are moved in unison by the transmission of rotational force passing from the axial translation grooves 234 of the shaft 216 to the corresponding complementary grooves in the grooved hole 314. As can be appreciated, the axial translation grooves 234 of the shaft 216 provide multiple functions. For instance, the grooves 234 provide a rotational locking between the friction rings 232 and the shaft 216 while allowing rotational force imparted on the shaft 216 to move the friction rings 232. In addition, the grooves 234 provide axial guides for the friction rings 232 such that each ring 232 can move axially, and even independently, along the shaft body section 258. Among other things, this axial movement, in concert with the force transmitted by the force members 240A, 240B and contact with the pressure disks 236, allows the friction rings 232 to be forced together and provides the resistance to rotation for the hinge mechanism 200.

In some embodiments, one or more of the first disk surface 310, the second disk surface 312, the first ring surface 318, and/or the second ring surface 320 may include a textured, indentations, bumps, or other interrupted and/or irregular surface. This irregular surface may provide more friction than a smooth surface. In some embodiments, one or more of the first disk surface 310, the second disk surface 312, the first ring surface 318, and/or the second ring surface 320 may be smooth, polished, or otherwise uninterrupted or of even surface consistency. In some embodiments, one of the pressure disk 236 and friction ring 232 may include an irregular surface and the other of the pressure disk 236 and friction ring 232 may include regular or smooth surface. In one embodiment, the pressure disk 236 and friction ring 232 may include similar surfaces or surface finishes in contact with one another at a pressure contact area 252A, 252B.

The pressure disks 236 and friction rings 232 may be made from the same, or similar materials. In one embodiment, the pressure disks 236 and friction rings 232 may be made from different or disparate materials. For instance, the pressure disk 236 and friction ring 232 may be made from one or more of ceramics, metals, non-metals, composites, etc., and/or combinations thereof. Examples of these materials may include, but are in no way limited to, glass, porcelain, aluminum, steel, copper, metal alloy, sintered metal, cellulose, aramid, polymer, organic polymer resin, thermoplastic, copolymers, etc., and/or combinations thereof.

Figure 4A:
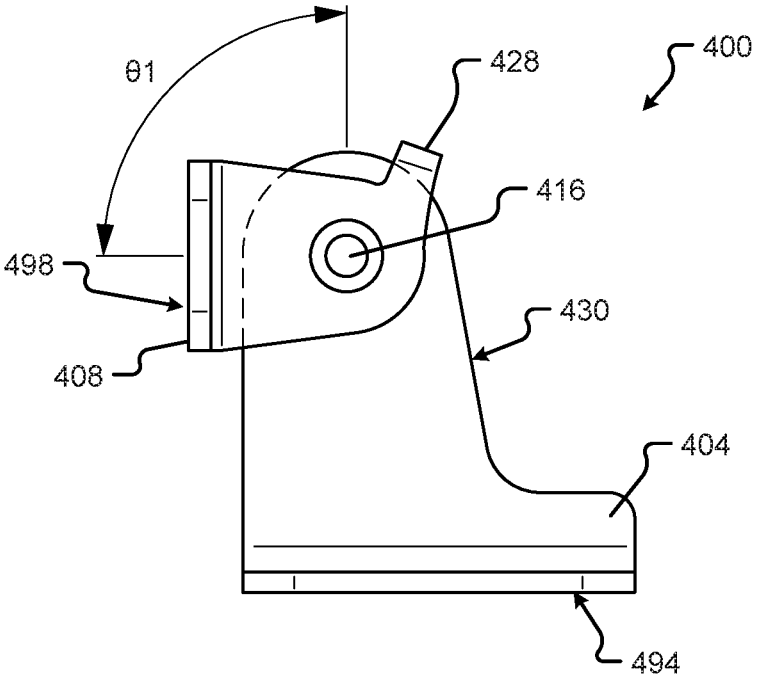
FIG. 4A is a plan view of a self-contained hinge mechanism in a first pivot state in accordance with embodiments of the present disclosure.
Figure 4B:
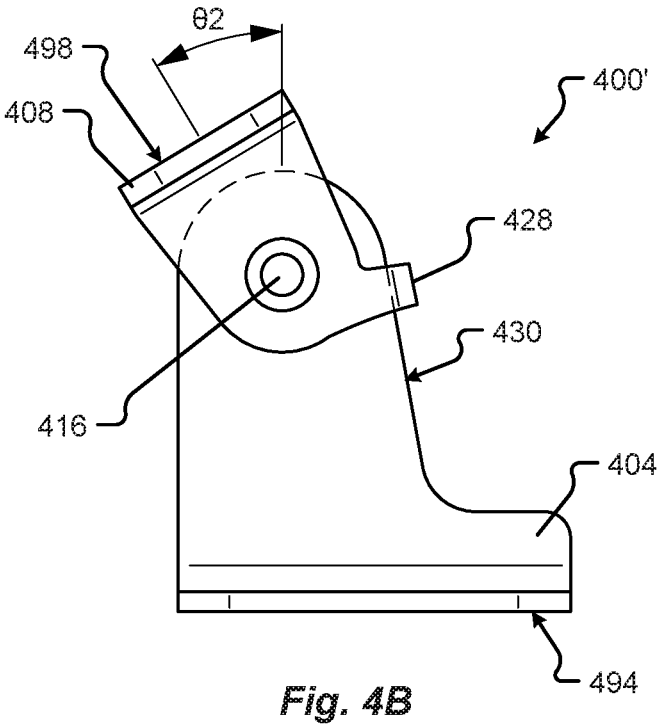
FIG. 4B is a plan view of the self-contained hinge mechanism of FIG. 4A in a second pivot state.

FIGS. 4A and 4B show schematic plan views of various pivot, or rotational, states of the self-contained hinge mechanism 400, 400' as described herein. The states of the self-contained hinge mechanisms 400, 400' described in conjunction with FIGS. 4A and 4B may be associated with the self-contained hinge mechanism 200 described in conjunction with FIGS. 1-3B above. The self-contained hinge mechanism shown in FIGS. 4A and 4B includes a frame bracket 404, shaft 416, door bracket 408, a door bracket hinge stop 428, and a frame bracket hinge stop surface 430. These components 404, 416, 408, 428, 430 may be the same or similar to the components 204, 216, 208, 228, 230 described in conjunction with the self-contained hinge mechanism 200.

FIG. 4A shows a plan view of the self-contained hinge mechanism in a first pivot state 400 in accordance with embodiments of the present disclosure. In some embodiments, the first pivot state 400 may correspond to a hinge-closed position for the self-contained hinge mechanism. For instance, when attached to a door 164A and frame 104 of a vehicle 100, the first pivot state 400 may correspond to the default position for the hinge mechanism when the door 164A of the vehicle 100 is closed. A first hinge pivot angle, θ1, defines a first angle measured between a datum of the door bracket 408 and a datum of the frame bracket 404. The first hinge pivot angle, θ1, may be the relative rotational angle of the door bracket 408 to the frame bracket 404 in the first pivot state. As shown in FIG. 4A, the datum of the frame bracket 404 is a hypothetical datum defined as a plane passing through the center axis of the shaft 416 and perpendicular to the frame bracket mount surface 494. The datum of the door bracket 408 is a hypothetical datum defined as a plane passing through the center axis of the shaft 416 and perpendicular to the door bracket mount surface 498.

In FIG. 4B, the door bracket 408 has been rotated in a clockwise direction such that the self-contained hinge mechanism is shown in a second pivot state 400'. In some embodiments, the second pivot state 400' may correspond to a hinge-fully-opened state for the self-contained hinge mechanism. In the second pivot state 400' the door bracket hinge stop 428 may contact the frame bracket hinge stop surface 430. By way of example, when the hinge mechanism is attached to a door 164A and frame 104 of a vehicle 100, the second pivot state 400' may correspond to an opening limit position for the hinge mechanism when the door 164A of the vehicle 100 is fully opened. A second hinge pivot angle, θ2, defines a second angle measured between the datum of the door bracket 408 and the datum of the frame bracket 404 described above. The second hinge pivot angle, θ2, may be the relative rotational angle of the door bracket 408 to the frame bracket 404 in the second pivot state 400'.

The difference between the first pivot angle, θ1, and the second pivot angle, θ2, defines the total angular movement range of the self-contained hinge mechanism. In some embodiments, the self-contained hinge mechanism may include an infinite number of relative rotational angles between the door bracket 408 and the frame bracket 404. The door bracket 408 may be held in any of these relative positions by the frictional elements in the hinge movement control assembly 300. For instance, the pressure contact force provided by the force members 240A, 240B may clamp or sandwich the friction rings 232 between opposing pressure disks 236. This clamping force may be configured to hold a door 164A attached to the door bracket 208, 408 at an angle set by a user when opening and/or closing the hinge mechanism 200. As can be appreciated, there are an infinite number of door positioning points over the total angular movement range of the hinge mechanism 200 employing the hinge movement control assembly 300.

It should be appreciated, that the first and second hinge pivot angles, θ1, θ2 of the self-contained hinge mechanism described herein may be different than those shown in FIGS.

4A and 4B and the actual measurement of the angle may not be accurately represented in the schematic drawings. For instance, one or more of the first and second hinge pivot angles, θ1, θ2 may include acute or obtuse angles. Additionally or alternatively, the total angular movement range of the self-contained hinge mechanism described herein may be greater than the total angular movement range shown as existing between the first and second pivot states 400, 400' of FIGS. 4A and 4B.

Figure 5A:
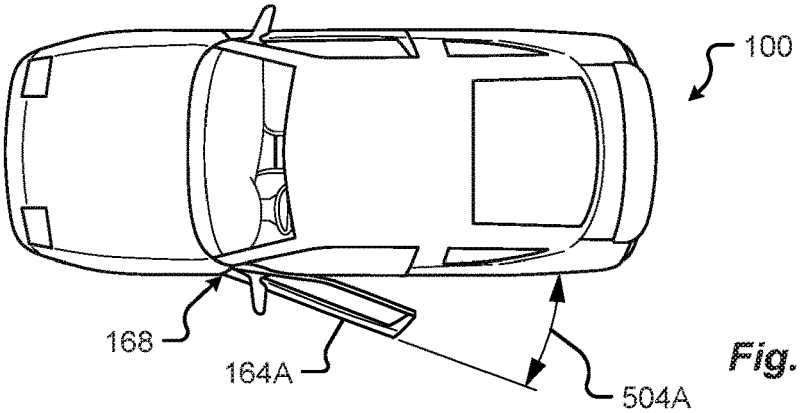
FIG. 5A is a plan view of a vehicle and a self-contained hinge mechanism pivoted at a first angle in accordance with embodiments of the present disclosure.
Figure 5B:
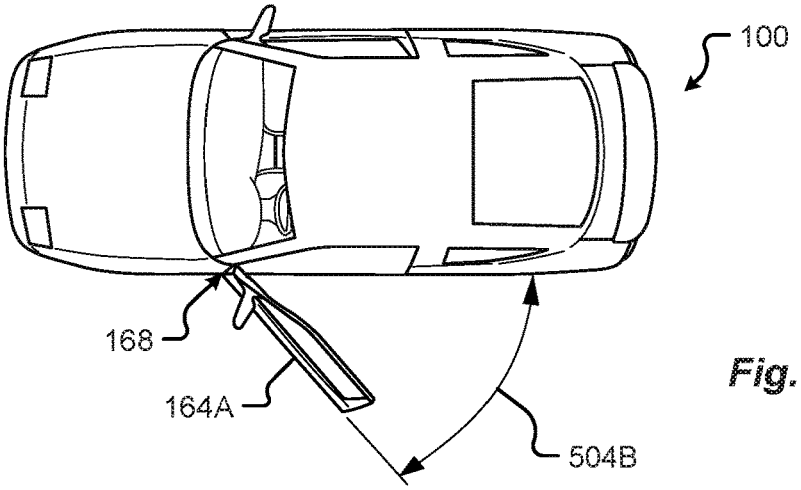
FIG. 5B is a plan view of a vehicle and a self-contained hinge mechanism pivoted at a second angle in accordance with embodiments of the present disclosure.
Figure 5C:
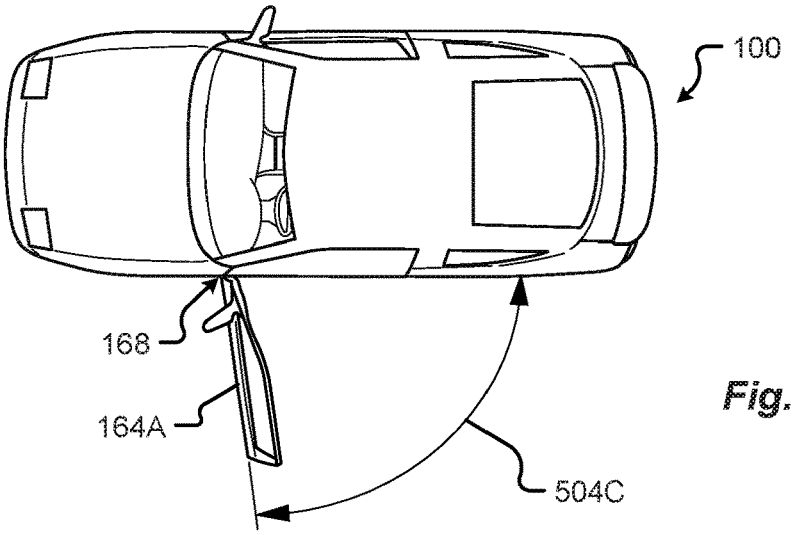
FIG. 5C is a plan view of a vehicle and a self-contained hinge mechanism pivoted at a third angle in accordance with embodiments of the present disclosure.

Referring to FIGS. 5A-5C, various plan views of a vehicle 100 and a door 164A connected at a hinge area 168 via a self-contained hinge mechanism are shown in accordance with embodiments of the present disclosure. In particular, FIGS. 5A-5C show three different opening positions for the door 164A of a vehicle 100 using the self-contained hinge mechanism described herein. FIG. 5A shows a plan view of the vehicle 100 where the self-contained hinge mechanism and door 164A are pivoted at a first angle 504A relative to the vehicle 100. In some embodiments, this first position and first angle 504A may be set by a user opening the door 164A. In one embodiment, the first angle 504A may correspond to a predefined first opening position for the hinge mechanism 200. This predefined first opening position may be set by at least one detent arranged in one or more components of the hinge movement control assembly 300, 600 (shown in FIG. 6). For example, as the door 164A is opened the pressure disks 236 of the hinge movement control assembly 300 may engage with at least one detent disposed in the friction ring 232 and/or vice versa. Once engaged with the at least one detent, the door 164A may be held in place in the first position shown in FIG. 5A.

FIG. 5B shows a plan view of the vehicle 100 where the self-contained hinge mechanism and door 164A are pivoted at a second, greater, angle 504B relative to the vehicle 100. In some embodiments, this second position and second angle 504B may be set by a user opening the door 164A further than the first position and first angle 504A. In one embodiment, the second angle 504B may correspond to a predefined second opening position for the hinge mechanism 200. This predefined second opening position may be set by at least one other detent arranged in one or more components of the hinge movement control assembly 300, 600 (shown in FIG. 6). Once engaged with the at least one other detent, the door 164A may be held in place in the second position shown in FIG. 5B.

FIG. 5C shows a plan view of the vehicle 100 where the self-contained hinge mechanism and door 164A are pivoted at a third, or fully-open, angle 504C relative to the vehicle 100. In some embodiments, this third position and third angle 504C may be set by a user opening the door 164A further than the second position and second angle 504B. In one embodiment, the third angle 504C may correspond to a predefined third opening position for the hinge mechanism 200. This predefined third opening position may be set by yet another detent arranged in one or more components of the hinge movement control assembly 300, 600 (shown in FIG. 6). Once engaged with this detent, the door 164A may be held in place in the third position shown in FIG. 5C.

Figure 6:
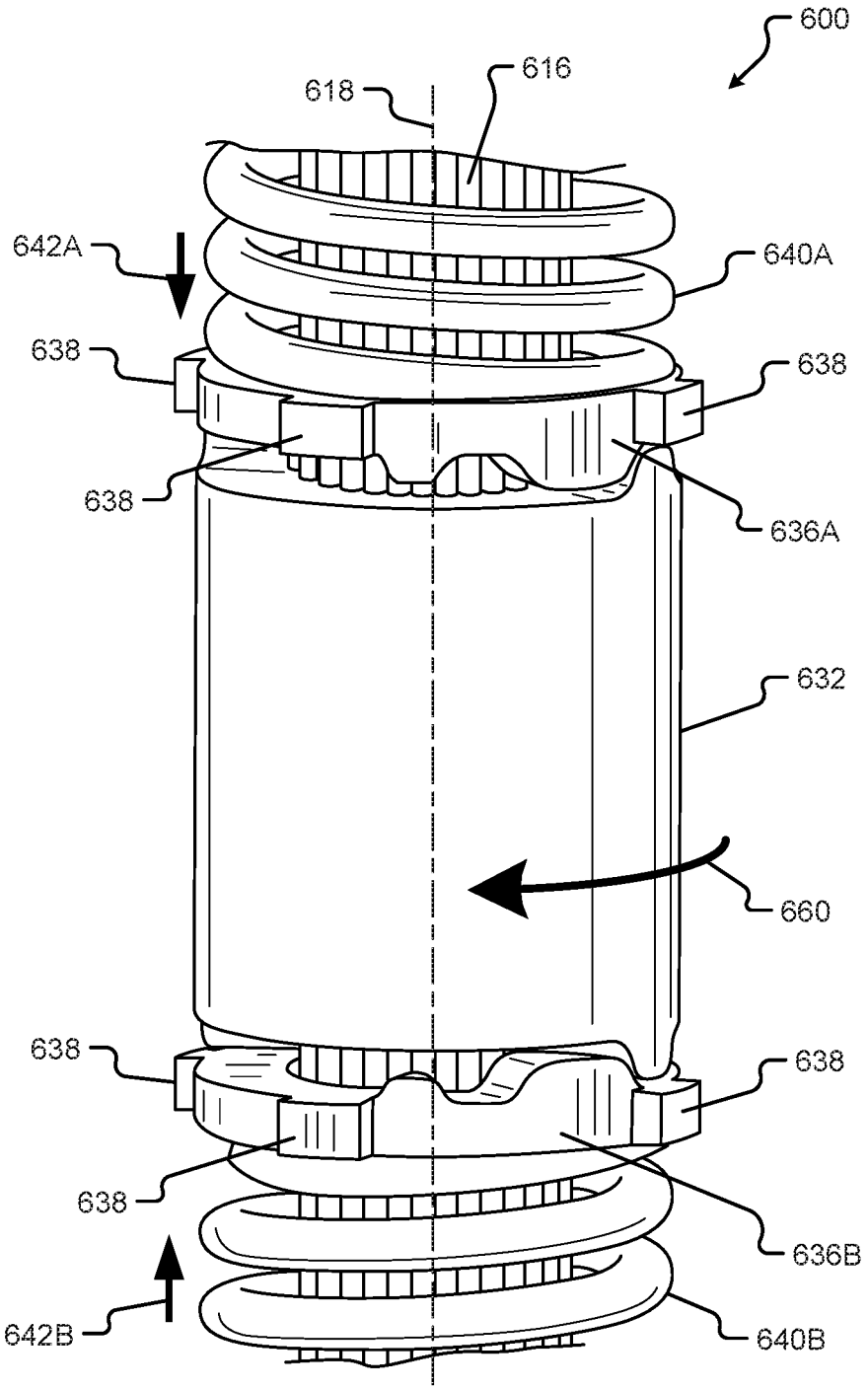
FIG. 6 is a detail perspective view of an embodiment of a hinge movement control assembly in a self-contained hinge mechanism in accordance with embodiments of the present disclosure.

FIG. 6 is a detail perspective view of an embodiment of a hinge movement control assembly 600 in a self-contained hinge mechanism 200 in accordance with embodiments of the present disclosure. In some embodiments, the self-contained hinge mechanism 200 may include different hinge movement control assemblies 300, 600 providing different hinge movement behaviors and/or operations. While all of the other components may remain the same as described at least in conjunction with FIGS. 2A-2C, the hinge movement control assembly 300 of the self-contained hinge mechanism 200 may be entirely, or partially, replaced with the hinge movement control assembly 600. The shaft 616, central axis 618, and force members 640A, 640B may be similar, if not identical, to the shaft 216, central axis 218, and force members 240A, 240B previously described.

The hinge movement control assembly 600 may include a cam ring 632 disposed between a first pressure cam disk 636A and a second pressure cam disk 636B. The force members 640A, 640B may exert a force against the pressure cam disks 636A, 636B in a force direction 642A, 642B, respectively. The pressure cam disks 636A, 636B may include one or more location tabs 638 disposed around a periphery of the pressure cam disks 636A, 636B. The location tabs 638 may be similar, if not identical, to the location tabs 238 described in conjunction with the pressure disks 236 above. For instance, the location tabs 638 of the pressure cam disks 636A, 636B may engage with the axial translation guides 214A-214D of the housing 212. The axial translation guides 214A-214D may be sized to accommodate the location tabs 638 with a slip fit or loose tolerance. Among other things, this slip fit allows the cam pressure disks 636A, 636B to translate, or move, axially along a portion of the housing 212 while simultaneously locking the rotation of each cam pressure disk 636A, 636B relative to the housing 212. In other words, the cam pressure disks 636A, 636B are rotationally locked to the housing 212 via the location tab 638 protrusion of the cam pressure disks 636A, 636B extending into a portion of the axial translation guides 214A-214D of the housing 212. Each of the cam pressure disks 636A, 636B include a through hole disposed substantially in the center of the cam pressure disks 636A, 636B. The through hole may be sized having a diameter that ensures clearance for the shaft 216, 616, such that the shaft 216, 616 does not contact the cam pressure disks 636A, 636B or any portion of the through hole when the self-contained hinge mechanism 200 is fully assembled.

Similar to the friction ring 232 described above, the cam ring 632 may be rotationally locked to the shaft 616 and rotate when the shaft 616 rotates about the central axis 618. For example, as the hinge mechanism 200 is actuated, the cam ring 632 may rotate in a first rotation direction 660 about the central axis 618. As the shaft 616 and cam ring 632 rotate, the cam pressure disk 636A, 636B remain rotationally locked to the housing 212. In some cases, this rotation may cause cam features of the cam ring 632 to move along cam surface features of each cam pressure disk 636A, 636B. As the cam ring 632 rotates, each cam pressure disk 636A, 636B may be displaced in an axial direction away from an axial center of the shaft 616 in a direction toward the force members 640A, 640B. In the event that the force members 640A, 640B are springs, this axial displacement may compress the springs providing greater resistance to rotation of in the hinge mechanism 200. In some embodiments, as the cam ring 632 rotates and follows the various cam surface features in the cam pressure disks 636A, 636B, the cam pressure disks 636A, 636B may axially displace in opposite directions to one another displacing away from or toward the axial center of the shaft 616. As provided above, if the force members 640A, 240B are configured as compression springs, the friction and/or rotational resistance of the hinge mechanism 200 may be tuned by presetting a compression of the compression springs. In one embodiment, this tuning may be achieved by inserting one or more spacers between the frame bracket 204A, 204B and the springs and/or between the hinge movement control assembly 300 and the springs (e.g., compressing the springs at a compressed height, etc.). In some cases, this tuning may be adjusted via at least one spring support member disposed inside the hinge mechanism 200 threaded to a portion of the shaft sleeves 244 or other component of the hinge mechanism 200 and in supportive contact with a base of the spring. To increase the friction and/or rotational resistance of the hinge mechanism 200 the spring support member may be rotated about the threaded axis and tightened against the compression spring (e.g., decreasing a height of the compressed compression spring, etc.). To decrease the friction and/or rotational resistance of the hinge mechanism 200 the spring support member may be rotated about the threaded axis and loosened from the compression spring (e.g., increasing a height of the compressed compression spring, etc.).

Figure 7:
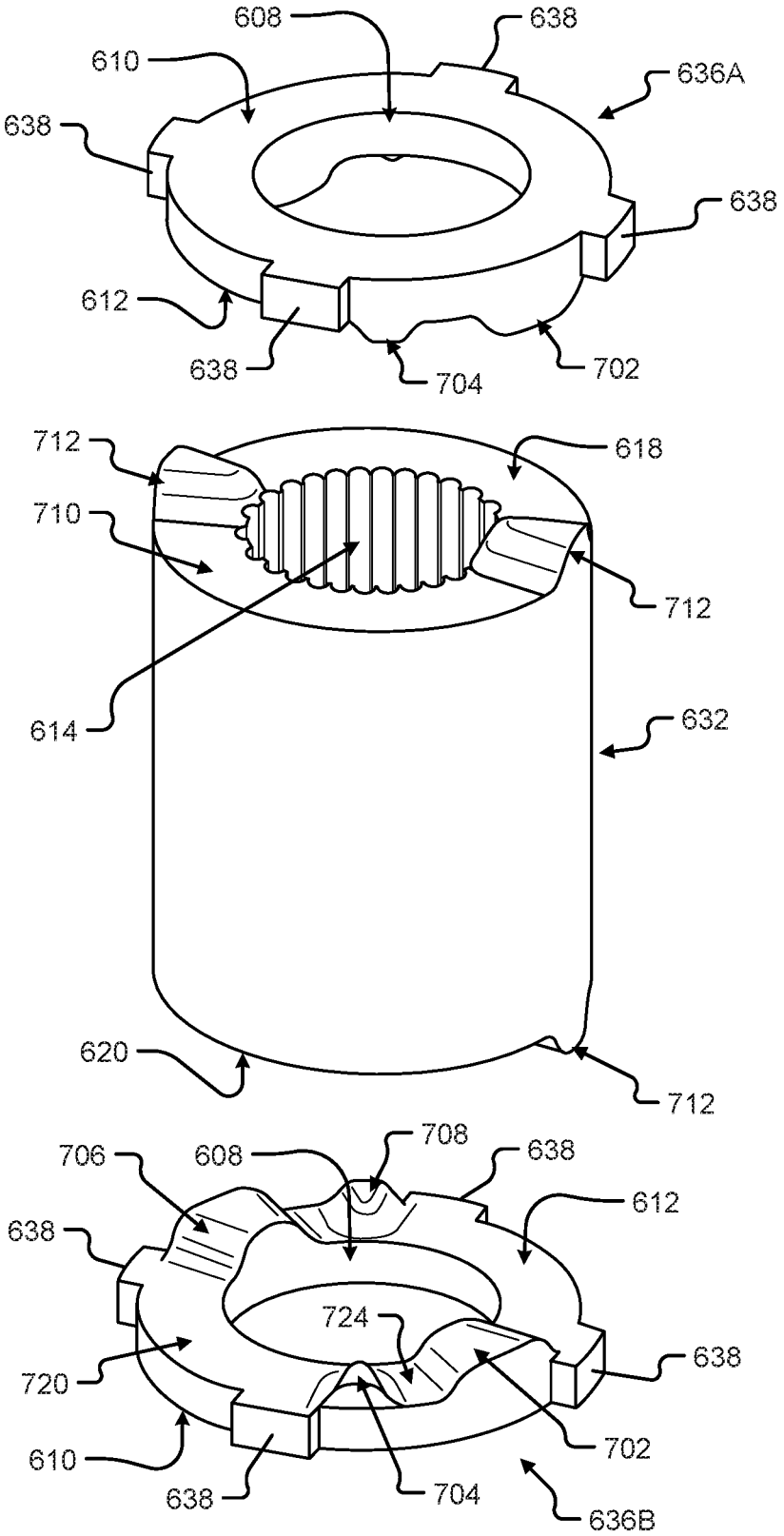
FIG. 7 is an exploded perspective view of an embodiment of a hinge movement control assembly in the self-contained hinge mechanism of FIG. 6.

FIG. 7 is an exploded perspective view of an embodiment of the hinge movement control assembly 600 in the self-contained hinge mechanism 200. The cam ring 632 is shown including one or more cam noses 712 disposed on the first cam ring surface 618. In some embodiments, the second cam ring surface 620 may include similar, if not identical, cam noses 712. The cam ring 632 may include a grooved hole 614 passing from the first cam ring surface 618 through to the second cam ring surface 620 opposite and spaced apart from the first cam ring surface 618 by a thickness of the cam ring 632. When the hinge mechanism 200 is fully-assembled, a portion of the shaft body section 258 is positioned inside the grooved hole 614 and each of the axial translation grooves 234 may interconnect, or mate, with corresponding complementary grooves in the grooved hole 614. In some embodiments, the grooved hole 614 may be a splined cut feature and the axial translation grooves 234 of the shaft 216, 616 may have complementary spline features (e.g., a splined shaft, etc.). In some embodiments, the axial translation grooves 234 and the grooves in the grooved hole 614 may be dimensioned such that the cam ring 632 may slidably engage with the axial translation grooves 234 of the shaft 216, 616. Once installed in the internal space 248 of the housing 212 and engaged with the axial translation grooves 234, the cam ring 632 is rotationally locked to the shaft 216, 616 but still able to move, translate, or slide, in an axial direction (e.g., following the axial translation grooves 234) of the shaft 216, 616.

During operation of the hinge mechanism 200, as the shaft 216, 616 is moved the cam ring 632 is moved along with the shaft 216, 616 by the transmission of rotational force passing from the axial translation grooves 234 of the shaft 216 to the corresponding complementary grooves in the grooved hole 614 of the cam ring 632. As can be appreciated, the axial translation grooves 234 of the shaft 216, 616 provide multiple functions. For instance, the grooves 234 provide a rotational locking between the cam ring 632 and the shaft 216, 616 while allowing rotational force imparted on the shaft 216, 616 to move the cam ring 632. In addition, the grooves 234 provide axial guides for the cam ring 632 such that the ring 632 can move axially along the shaft body section 258. Among other things, this axial movement, in concert with the force transmitted by the force members 640A, 640B, allows the cam ring 632 to be essentially clamped or sandwiched by the cam pressure disks 636A, 636B providing a certain resistance to rotation for the hinge mechanism 200.

As illustrated in FIG. 7, each of the cam pressure disk 636A, 636B may be structured as a disk having a shaft clearance hole 608 passing from a first disk surface 610 through to a second disk surface 612 opposite and spaced apart from the first disk surface 610 by a thickness of the cam pressure disk 636A, 636B. The first disk surface 610 may be configured as a substantially flat surface. This first disk surface 610 of each cam pressure disk 636A, 636B may be oriented in the hinge mechanism 200 to contact a corresponding force member 640A, 640B. Each pressure cam disk 636A, 636B may include one or more location tabs 638 protruding outwardly from a center of the pressure cam disks 636A, 636B in a radial direction. In some embodiments, the location tabs 638 may be in a same plane as the first cam disk surface 610. The location tabs 638 may be sized to slidably engage with the axial translation guides 214A-214D of the housing 212. Once installed in the internal space 248 of the housing 212 and engaged with the axial translation guides 214A-214D, the pressure cam disks 636A, 636B may be rotationally locked to the housing 212 but able to move, translate, or slide, in an axial direction (e.g., following the axial translation guides 214A-214D, etc.).

The second disk surface 612 may include an undulated or irregular surface having one or more cam surface features 702, 704, 706, 708, 720, 728 formed thereon. For instance, the second disk surface 612 may include a first cam feature 702 and a second cam feature 704 separated from the first cam feature 702 by a chord length or other radial distance. In some embodiments, the first and second cam features 702, 704 may correspond to raised portions (e.g., bumps, protrusions, etc.) formed on the second disk surface 612. In addition, the second disk surface 612 may include one or more dwell regions 720, 724. As shown in FIG. 7, a long dwell region 720 is disposed between the second cam feature 704 and a third cam feature 706, while a short dwell region 724 is disposed between the first cam feature 702 and the second cam feature 704.

These cam surface features may provide various operational and/or movement behavior for the hinge mechanism 200. For instance, as the cam ring 632 is rotated relative to the rotationally fixed pressure cam disks 636A, 636B, the noses 712 may follow the contours of the undulated surface of the second disk surface 612. Once the noses 712 of the cam ring 632 reach a raised cam surface feature (e.g., first cam feature 702, second cam feature 704, third cam feature 706, and/or fourth cam feature 708) the rotational force required to continue rotation of the shaft 216, 616 and cam ring 632 increases (e.g., requiring displacement of the cam disks 636A, 636B against the force members 640A, 640B in a direction away from the axial center of the shaft 216, 616 and opposite the force member force directions 642A, 642B, etc.). After the cam ring 632 overcomes the increased rotational force required to move past the raised cam surface feature, the nose 712 may continue to follow the cam surface feature to a dwell region 720, 724 of the pressure cam disks 636A, 636B. Among other things, movement of the cam ring 632 along a dwell region may provide a resistance to rotation based on the force of the force members 640A, 640B and the pressure contact areas between the pressure cam disks 636A, 636B and the cam ring 632. In some embodiments, the raised portions, or areas between the raised portions, of the second disk surface 612 may serve as the detents described above and in conjunction with FIGS. 5A-5C. Additionally or alternatively the door 164A of the vehicle 100 may be held in a position based on the location of the raised portions disposed on the second cam disk surface 612.

The cam pressure disks 636A, 636B and the cam ring 632 may be made from the same, or similar materials. In one embodiment, the cam pressure disks 636A, 636B and cam ring 632 may be made from different or disparate materials. For instance, the cam pressure disks 636A, 636B and cam ring 632 may be made from one or more of ceramics, metals, non-metals, composites, etc., and/or combinations thereof. Examples of these materials may include, but are in no way limited to, glass, porcelain, aluminum, steel, copper, metal alloy, sintered metal, cellulose, aramid, polymer, organic polymer resin, thermoplastic, copolymers, etc., and/or combinations thereof. In some embodiments, the first pressure disk 636A may include cam features disposed on the second cam disk surface 612 of the first pressure disk 636A that are opposite to but axially aligned with identical cam features disposed on the second cam disk surface 612 of the second pressure disk 636B. In other words, the first pressure disk 636A may be a mirror of the second pressure disk 636B, or vice versa.

FIGS. 8A-8H show views of various shaft cross-section geometries in accordance with embodiments of the present disclosure. The views may be taken substantially along line X-X of FIG. 2C. While the present disclosure describes a number of axial translation grooves, or splines, disposed around a periphery of the shaft running in an axial direction of the shaft, it is an aspect of the present disclosure that the shaft may include any number of different friction ring rotational locking features. These features may correspond to grooves, cuts, scallops, shapes, or other features associated with the shaft. As can be appreciated, the various geometries described herein may be substituted for any shaft 216, 616 described in conjunction with any of FIGS. 1-7 above.

Figure 8A:
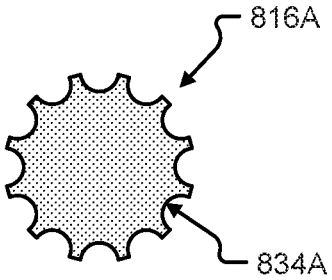
FIG. 8A is a cross-sectional view taken substantially along line X-X of FIG. 2C of a first embodiment of a shaft in accordance with embodiments of the present disclosure.
Figure 8B:
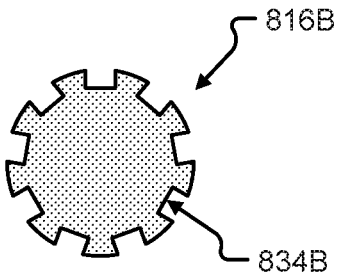
FIG. 8B is a cross-sectional view taken substantially along line X-X of FIG. 2C of a second embodiment of a shaft in accordance with embodiments of the present disclosure.
Figure 8C:
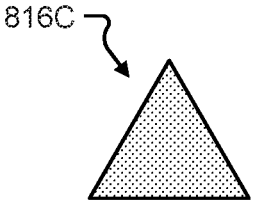
FIG. 8C is a cross-sectional view taken substantially along line X-X of FIG. 2C of a third embodiment of a shaft in accordance with embodiments of the present disclosure.
Figure 8D:
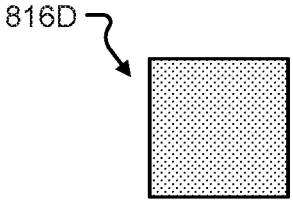
FIG. 8D is a cross-sectional view taken substantially along line X-X of FIG. 2C of a fourth embodiment of a shaft in accordance with embodiments of the present disclosure.
Figure 8E:
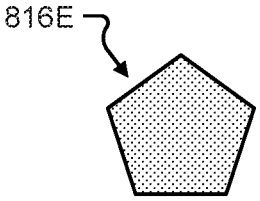
FIG. 8E is a cross-sectional view taken substantially along line X-X of FIG. 2C of a fifth embodiment of a shaft in accordance with embodiments of the present disclosure.
Figure 8F:
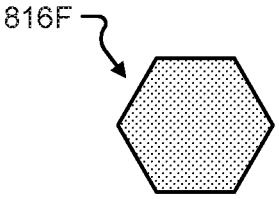
FIG. 8F is a cross-sectional view taken substantially along line X-X of FIG. 2C of a sixth embodiment of a shaft in accordance with embodiments of the present disclosure.
Figure 8G:
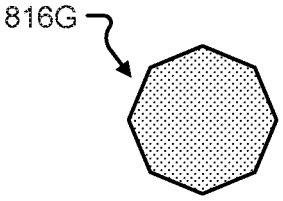
FIG. 8G is a cross-sectional view taken substantially along line X-X of FIG. 2C of a seventh embodiment of a shaft in accordance with embodiments of the present disclosure.
Figure 8H:
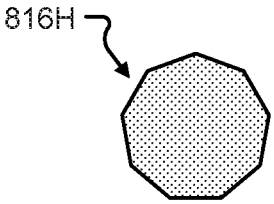
FIG. 8H is a cross-sectional view taken substantially along line X-X of FIG. 2C of an eighth embodiment of a shaft in accordance with embodiments of the present disclosure.

FIGS. 8A and 8B show cross-sectional views of a shaft 816A, 816B having axial a number of axial translation grooves 834A, 834B disposed around a periphery of the shaft 816A, 816B. In some embodiments, the grooves may be substantially arcuate as illustrated with the scalloped grooves 834A of FIG. 8A. In some embodiments, the grooves may be substantially rectangular, similar to a splined feature, as illustrated with the spline-shaped grooves 834B of FIG. 8B. As described above, corresponding or mating features may be found in the hole or center of the friction rings 232.

Additionally or alternatively, the polygonal shape of the shaft 216, 616, or a portion thereof may provide a rotation-locking feature for one or more of the friction rings 232 described herein. For instance, FIGS. 8C-8H show the polygonal shafts 816C-816H as having a limited number of sides. Unlike a circular shaft, the limited number of sides in the polygonal shafts 816C-816H may interconnect with corresponding or mating polygonal features in the hole or center of the friction rings 232. In particular, the polygonal shafts 816C-816H may include three sides (e.g., triangular shaft 816C), four sides (e.g., rectangular or square shaft 816D), five sides (e.g., pentagonal shaft 816E), six sides (e.g., hexagonal shaft 816F), seven sides, eight sides (e.g., octagonal shaft 816G), nine sides (e.g., nonagonal shaft 816H), and/or more sides configured to provide an anti-rotational lock between the shaft 216, 616 and the friction rings 232.

The exemplary systems and methods of this disclosure have been described in relation to vehicle door hinges. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

A number of variations and modifications of the disclosure can be used. It would be possible to provide for some features of the disclosure without providing others.

The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Embodiments include a self-contained hinge mechanism, comprising: a housing; a shaft having a body section disposed inside the housing, the shaft rotationally coupled to the housing; a plurality of friction rings arranged along an axial length of the body section of the shaft, wherein each friction ring in the plurality of friction rings is rotationally-locked to the body section of the shaft; a plurality of pressure contact disks rotationally-locked inside the housing, wherein each friction ring of the plurality of friction rings is sandwiched between two pressure contact disks of the plurality of pressure contact disks; a first force member adjacent to a first end of the body section and in compressive contact with a first pressure contact disk of the plurality of pressure contact disks; and a second force member adjacent to a second end of the body section and opposing the first force member, wherein the second force member is in compressive contact with a second pressure contact disk of the plurality of pressure contact disks.

Aspects of the above mechanism include wherein the opposing force members provide a clamp force compressing the plurality of friction rings between the plurality of pressure contact disks and provide a resistance to rotational movement of the shaft relative to the housing. Aspects of the above mechanism further comprising: a first mount bracket fixedly attached to the housing; and a second mount bracket rotationally-keyed to the shaft, wherein the second mount bracket is configured to pivot relative to the first mount bracket about a longitudinal axis of the shaft and against the clamp force. Aspects of the above mechanism include wherein the housing is configured as a substantially hollow shape having a wall extending from a first end of the housing to a second end of the housing, wherein the housing includes one or more rotational lock channels disposed in the wall and extending along an axial length of the housing. Aspects of the above mechanism include wherein each pressure contact disk of the plurality of pressure contact disks further comprises: a substantially planar first surface; a second surface disposed opposite the substantially planar first surface offset by a disk thickness; a shaft clearance hole passing from the substantially planar first surface to the second surface; and at least one tab extending from a periphery of the pressure contact disk, the at least one tab engaged with the one or more rotational lock channels disposed in the wall of the housing, wherein the pressure contact disk is rotationally-locked to the housing via the engagement of the at least one tab with the one or more rotational lock channels. Aspects of the above mechanism include wherein the one or more rotational lock channels provide an axial movement guide for each pressure contact disk of the plurality of pressure contact disks. Aspects of the above mechanism include wherein the shaft includes one or more friction ring rotational locking features extending along at least a portion of the axial length of the body section. Aspects of the above mechanism include wherein each friction ring of the plurality of friction rings further comprises: a first surface; a second surface disposed opposite the first surface and offset by a ring thickness; and an anti-rotation hole feature passing from the first surface to the second surface, wherein the anti-rotation hole feature includes complementary locking features to the one or more friction ring rotational locking features of the shaft, and wherein each friction ring is rotationally-locked to the body section of the shaft via the engagement of the complementary locking features of with the one or more friction ring rotational locking features. Aspects of the above mechanism include wherein the body section of the shaft further comprises a polygonal-shaped cross-section, and wherein the anti-rotation hole feature of each friction ring of the plurality of friction rings includes a substantially similar polygonal-shaped cross-section. Aspects of the above mechanism include wherein the body section of the shaft further comprises splined-shaft features, and wherein the anti-rotation hole feature of each friction ring of the plurality of friction rings includes splined-hole features. Aspects of the above mechanism include wherein the second mount bracket includes a keyway and the shaft includes a key engaged with the keyway rotationally-keying the second mount bracket to the shaft. Aspects of the above mechanism include wherein the first and second force members are compression springs. Aspects of the above mechanism include wherein the first and second force members are linear actuators. Aspects of the above mechanism include wherein the first mount bracket includes one or more vehicle frame mount features, and wherein the second mount bracket includes one or more vehicle door mount features. Aspects of the above mechanism include wherein the first mount bracket closes an open end of the housing and the first force member is compressed between the first mount bracket and the first pressure contact disk of the plurality of pressure contact disks.

Embodiments include a hinge mechanism, comprising: a housing: a shaft having an axial center disposed within the housing; a first mount bracket fixedly attached to the housing and pivotally attached to the shaft; a second mount bracket fixedly attached to the shaft; a stack of alternating pressure contact disks and friction rings disposed along a portion of the shaft adjacent to the axial center, wherein the pressure contact disks are rotationally-locked to the housing, wherein the friction rings are rotationally-locked to the shaft; a first force member disposed at a first end of the stack and axially compressed against a first pressure contact disk in the stack; and a second force member disposed a second end of the stack and opposing the first force member, the second force member axially compressed against a second pressure contact disk in the stack.

Aspects of the above mechanism further comprising: a first mount bracket fixedly attached to the housing; and a second mount bracket rotationally-keyed to the shaft, wherein the second mount bracket is configured to pivot relative to the first mount bracket about a longitudinal axis of the shaft. Aspects of the above mechanism include wherein the housing includes axial translation guides extending from a first end of the housing to a second end of the housing, wherein the axial translation guides provide the rotational lock of the pressure contact disks to the housing and provide guide channels for axial translation of one or more of the pressure contact disks inside the housing. Aspects of the above mechanism include wherein the shaft includes axial translation grooves extending along a portion of the shaft adjacent to the axial center, wherein the axial translation grooves provide the rotational lock of the friction rings to the shaft and provide guide grooves for axial translation of one or more of the friction rings along the shaft.

Embodiments include a self-contained hinge mechanism, comprising: a movable pivot assembly, comprising: a first bracket; a shaft rotationally fixed to the first bracket; and a plurality of friction rings rotationally keyed to the shaft; a fixed mount assembly pivotally coupled to the movable pivot assembly via the shaft, comprising: a second bracket; a housing rotationally fixed to the second bracket, the housing including a hollow portion configured to receive a portion of the shaft and plurality of friction rings; and a plurality of pressure contact disks rotationally keyed to the housing and arranged in an alternating stack with the plurality of friction rings, wherein each of the plurality of friction rings in the stack is sandwiched between two of the plurality of pressure contact disks, and wherein the stack includes a first pressure contact disk disposed at a first end of the stack and a second contact disk disposed at an opposite second end of the stack; a first spring member disposed at least partially inside the housing and compressed against the first pressure contact disk; and a second spring member disposed at least partially inside the housing and compressed against the second pressure contact disk, wherein the compression of the first and second spring members against the pressure contact disks compresses the stack and resists rotational movement of the movable pivot assembly relative to the fixed mount assembly.

Any one or more of the aspects/embodiments as substantially disclosed herein.

Any one or more of the aspects/embodiments as substantially disclosed herein optionally in combination with any one or more other aspects/embodiments as substantially disclosed herein.

One or means adapted to perform any one or more of the above aspects/embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

What is claimed is:

1. A self-contained hinge mechanism, comprising:

a housing;

a shaft having a body section disposed inside the housing, the shaft rotationally coupled to the housing;

a plurality of friction rings arranged along an axial length of the body section of the shaft, wherein each friction ring in the plurality of friction rings is rotationally-locked to the body section of the shaft;

a plurality of pressure contact disks rotationally-locked inside the housing, wherein each friction ring of the plurality of friction rings is in contact with and sandwiched between two pressure contact disks of the plurality of pressure contact disks;

a first force member adjacent to a first end of the body section and in compressive contact with a first pressure contact disk of the plurality of pressure contact disks; and a second force member adjacent to a second end of the body section and opposing the first force member, wherein the second force member is in compressive contact with a second pressure contact disk of the plurality of pressure contact disks, wherein the first force member and the second force member are both contained within the housing, and wherein the first force member and the second force member apply a compressive force toward one another clamping the plurality of friction rings and the plurality of pressure contact disks together and providing a resistance to rotational movement of the shaft relative to the housing.

2. The self-contained hinge mechanism of claim 1, wherein each friction ring of the plurality of friction rings is arranged as a substantially flat disk, and wherein each pressure contact disk of the plurality of pressure contact disks is arranged as substantially flat disk.

3. The self-contained hinge mechanism of claim 1, further comprising:

a first mount bracket fixedly attached to the housing; and a second mount bracket disposed outside of the first mount bracket and the housing, the second mount bracket rotationally-keyed to the shaft, wherein the second mount bracket is configured to pivot relative to the first mount bracket about a longitudinal axis of the shaft and against the compressive force.

4. The self-contained hinge mechanism of claim 3, wherein the housing is separate from the first mount bracket and the second mount bracket, wherein the housing is configured as a substantially hollow shape having a wall extending from a first end of the housing to a second end of the housing, wherein the housing includes one or more rotational lock channels disposed in the wall and extending along an axial length of the housing.

5. The self-contained hinge mechanism of claim 4, wherein each pressure contact disk of the plurality of pressure contact disks further comprises:

a substantially planar first contact surface;

a second contact surface disposed opposite the substantially planar first contact surface offset by a disk thickness, wherein the second contact surface is substantially planar and parallel to the substantially planar first contact surface;

a shaft clearance hole passing from the substantially planar first contact surface to the second contact surface; and at least one tab extending from a periphery of each pressure contact disk, the at least one tab engaged with the one or more rotational lock channels disposed in the wall of the housing, wherein each pressure contact disk is rotationally-locked to the housing via the engagement of the at least one tab with the one or more rotational lock channels.

6. The self-contained hinge mechanism of claim 5, wherein the one or more rotational lock channels provide an axial movement guide for each pressure contact disk of the plurality of pressure contact disks.

7. The self-contained hinge mechanism of claim 6, wherein the shaft includes friction ring rotational locking features extending along at least a portion of the axial length of the body section.

8. The self-contained hinge mechanism of claim 7, wherein each friction ring of the plurality of friction rings further comprises:

a substantially planar first contact surface;

a substantially planar second contact surface disposed opposite the first contact surface and offset by a ring thickness; and an anti-rotation hole feature passing from the first contact surface to the second contact surface, wherein the anti-rotation hole feature includes locking features that engage with the friction ring rotational locking features, rotationally-locking each friction ring to the body section of the shaft.

9. The self-contained hinge mechanism of claim 8, wherein the friction ring rotational locking features comprise a polygonal-shaped cross-section shape of the body section, and wherein the locking features of the anti-rotation hole feature of each friction ring comprise a cross-sectional shape matching the polygonal-shaped cross-section shape of the body section.

10. The self-contained hinge mechanism of claim 8, wherein the friction ring rotational locking features comprise splined-shaft grooves running along a portion of the body section, and wherein the locking features of the anti-rotation hole feature of each friction ring comprise a splined-hole that mates with the grooves.

11. The self-contained hinge mechanism of claim 8, wherein the second mount bracket includes a keyway and the shaft includes a key engaged with the keyway rotationally-keying the second mount bracket to the shaft such that the second mount bracket and the shaft rotate in unison with one another.

12. The self-contained hinge mechanism of claim 8, wherein the first and second force members are compression springs.

13. The self-contained hinge mechanism of claim 8, wherein the first and second force members are first and second linear actuators, wherein the first linear actuator comprises a first body axially-fixed relative to the shaft and a first movable element interconnected with the first body and extendable from the first body in a first direction parallel to the axial length of the body section of the shaft, wherein the first movable element is in the compressive contact with the first pressure contact disk, wherein the second linear actuator comprises a second body axially-fixed relative to the shaft and a second movable element interconnected with the second body and extendable from the second body in a second direction parallel to the axial length of the body section of the shaft and opposite the first direction, and wherein the second movable element is in the compressive contact with the second pressure contact disk.

14. The self-contained hinge mechanism of claim 8, wherein the first mount bracket includes one or more vehicle frame mount features, and wherein the second mount bracket includes one or more vehicle door mount features.

15. The self-contained hinge mechanism of claim 8, wherein the first mount bracket closes an open end of the housing and the first force member is compressed between the first mount bracket and the first pressure contact disk of the plurality of pressure contact disks.

16. A hinge mechanism, comprising:

a housing:

a shaft having an axial center disposed within the housing;

a first mount bracket fixedly attached to the housing and pivotally attached to the shaft adjacent to a first axial end of the hinge mechanism;

a second mount bracket fixedly attached to the shaft adjacent to the first axial end of the hinge mechanism;

a stack of alternating pressure contact disks and friction rings disposed along a portion of the shaft adjacent to the axial center, wherein the pressure contact disks are rotationally-locked to the housing, wherein the friction rings are rotationally-locked to the shaft, and wherein each friction ring contacts at least two pressure contact disks in the stack of alternating pressure contact disks and friction rings;

a first force member disposed at a first end of the stack and axially compressed against and in contact with a first pressure contact disk in the stack at the first end; and a second force member disposed at a second end of the stack and opposing the first force member, the second force member axially compressed against and in contact with a second pressure contact disk in the stack at the second end, wherein the first force member and the second force member are both contained within the housing, and wherein the first force member and the second force member apply a compressive force toward one another clamping the stack of alternating pressure contact disks and friction rings together and providing a resistance to rotational movement of the shaft relative to the housing.

17. The hinge mechanism of claim 16, further comprising:

a third mount bracket fixedly attached to the housing adjacent to a second axial end of the hinge mechanism, the second axial end of the hinge mechanism disposed opposite the first axial end of the hinge mechanism; and a fourth mount bracket rotationally-keyed to the shaft adjacent to the second axial end of the hinge mechanism, wherein the second mount bracket is configured to pivot relative to the first mount bracket in conjunction with the second mount bracket about a longitudinal axis of the shaft.

18. The hinge mechanism of claim of claim 17, wherein the housing includes axial translation guides extending from a first end of the housing to a second end of the housing, wherein the axial translation guides provide the rotational lock of the pressure contact disks to the housing and provide guide channels for axial translation of one or more of the pressure contact disks inside the housing.

19. The hinge mechanism of claim of claim 18, wherein the shaft includes axial translation grooves extending along a portion of the shaft adjacent to the axial center, wherein the axial translation grooves provide the rotational lock of the friction rings to the shaft and provide guide grooves for axial translation of one or more of the friction rings along the shaft.

20. A self-contained hinge mechanism, comprising:

a movable pivot assembly, comprising:

a first movable bracket portion;

a second movable bracket portion offset a distance from the first movable bracket portion:

a shaft rotationally fixed to the first movable bracket portion at a first end of the shaft and the second movable bracket portion at an opposite second end of the shaft; and a plurality of friction rings rotationally keyed to the shaft, wherein the first movable bracket portion, the second movable bracket portion, the shaft, and the plurality of friction rings all rotate in unison with one another;

a fixed mount assembly pivotally coupled to the movable pivot assembly via the shaft, comprising:

a first fixed bracket portion disposed adjacent to the first movable bracket portion;

a second fixed bracket portion offset a distance from the first fixed bracket portion and disposed adjacent to the second moveable bracket portion;

a housing rotationally fixed to the first fixed bracket portion and the second fixed bracket portion, the housing including a hollow portion configured to receive a portion of the shaft and the plurality of friction rings; and a plurality of pressure contact disks rotationally keyed to the housing preventing the plurality of pressure contact disks from rotating relative to the housing, wherein the plurality of pressure contact disks are arranged in an alternating stack with the plurality of friction rings, wherein each of the plurality of friction rings in the stack is in contact with and sandwiched between two of the plurality of pressure contact disks, and wherein the stack includes a first pressure contact disk disposed at a first end of the stack and a second contact disk disposed at an opposite second end of the stack;

a first spring member disposed inside the housing and compressed against the first pressure contact disk; and a second spring member disposed inside the housing and compressed against the second pressure contact disk, wherein the compression of the first and second spring members against the pressure contact disks compresses the plurality of friction rings and the plurality of pressure contact disks together in the stack and resists rotational movement of the movable pivot assembly relative to the fixed mount assembly;

wherein the first fixed bracket portion and the second fixed bracket portion are disposed between the first movable bracket portion and the second movable bracket portion.

* * * * *